US012773039B2

(12) United States Patent
Davis

(10) Patent No.: US 12,773,039 B2
(45) Date of Patent: Oct. 27, 2026

(54) HOLDER FOR VACCINE GUNS

(71) Applicant: Seth Joseph Davis, Ordway, CO (US)

(72) Inventor: Seth Joseph Davis, Ordway, CO (US)

( * ) Notice: Subject to any disclaimer, the term of this patent is extended or adjusted under 35 U.S.C. 154(b) by 46 days.

(21) Appl. No.: 18/779,217

(22) Filed: Jul. 22, 2024

(65) Prior Publication Data

US 2025/0049202 A1 Feb. 13, 2025

Related U.S. Application Data

(60) Provisional application No. 63/531,529, filed on Aug. 8, 2023.

(51) Int. Cl.
*A45F 5/14* (2006.01)
*A45F 5/00* (2006.01)

(52) U.S. Cl.
CPC ..... *A45F 5/14* (2013.01); *A45F 2005/002* (2013.01)

(58) Field of Classification Search
CPC ..... A45F 2003/008; A45F 5/14; A45F 2005/002; A45F 2005/008; A45F 5/021; A45F 5/1566; A45C 2011/007; B25H 3/006; A61M 5/002; A61M 5/1417; A61M 5/14244; A61M 2209/088; A61D 1/025
USPC ..... 224/904, 661, 256, 269, 271, 200
See application file for complete search history.

(56) References Cited

U.S. PATENT DOCUMENTS 4,830,247 A * 5/1989 Banks ..... B25H 3/006 224/678
4,858,798 A 8/1989 Siddoway et al.
4,960,239 A * 10/1990 Wait ..... A63B 57/50 473/406
5,940,883 A 8/1999 Daoust
6,315,182 B1 * 11/2001 Chen ..... B60R 11/0241 224/547
6,405,910 B1 6/2002 Infanti et al.
6,547,118 B2 * 4/2003 Beletsky ..... A45F 5/00 224/684

(Continued)

FOREIGN PATENT DOCUMENTS

JP H05146475 A * 6/1993 ..... A61M 5/3205

OTHER PUBLICATIONS

JP H05146475 with Translation (Year: 1993).*

(Continued)

*Primary Examiner* — Adam J Waggenspack
(74) *Attorney, Agent, or Firm* — Trenner Law Firm, LLC; Mark Trenner

(57) ABSTRACT

A holder for vaccine guns is disclosed. An example holder for vaccine guns includes a base member for attaching to a side of a person. The example holder for vaccine guns also includes a mounting plate attached to the base member. The mounting plate has a receiving channel. The example holder for vaccine guns also includes an interchangeable sleeve configured to receive at least a portion of a first vaccine gun therein. The interchangeable sleeve engages with the receiving channel of the mounting plate to releasably mount the sleeve to the mounting plate. The interchangeable sleeve is removable from the mounting plate for replacement with a different sleeve for a second vaccine gun. The second vaccine gun can be a different type from the first vaccine gun so that the holder can be implemented with a variety of different types of vaccine guns.

18 Claims, 25 Drawing Sheets

(56) References Cited

U.S. PATENT DOCUMENTS

| | | | | |
|---|---|---|---|---|
| 6,889,878 | B2 * | 5/2005 | Parsons | A45F 5/02 224/678 |
| 6,955,280 | B2 * | 10/2005 | Saitoh | B60R 11/0241 224/547 |
| 7,409,237 | B2 * | 8/2008 | Tages | H04M 1/04 455/575.1 |
| 7,757,913 | B2 | 7/2010 | Fichera | |
| 9,551,367 | B1 * | 1/2017 | Shieh | A45F 5/021 |
| 2002/0008128 | A1 * | 1/2002 | Field | B25H 3/006 224/678 |
| 2007/0181619 | A1 * | 8/2007 | Seyfert | F41C 33/04 224/912 |
| 2008/0017683 | A1 * | 1/2008 | Votel | A45F 5/02 224/904 |
| 2008/0185412 | A1 * | 8/2008 | Hollins | A45F 5/02 224/660 |
| 2010/0276464 | A1 * | 11/2010 | Hirt | F41C 33/046 224/271 |
| 2013/0032617 | A1 | 2/2013 | Adelman et al. | |
| 2023/0108400 | A1 * | 4/2023 | Schuda | F41C 33/045 224/243 |

OTHER PUBLICATIONS

QC Supply—Ezepak Gun Holster downloaded from URL https://www.qcsupply.com/ezepak-gun-holster.html on Sep. 15, 2023 and possibly available earlier.

EZE Pack Drench & Pour-On Belt and Gun Holster System—Wormer Livestock downloaded URL https://www.amazon.com/EZE-Drench-Holster-System-Livestock/dp/B00FG3UMV8 on Sep. 15, 2023 and possibly available earlier.

Think Livestock—Ezepak Drench and Injector Holster downloaded from URL https://www.thinklivestock.com/product/ezepak-drench-and-injector-holster/ on Sep. 15, 2023 and possibly available earlier (Copyright Notice 2017).

Ezepak Brochure: Innovative Accessories For Animal Health downloaded from URL https://www.ezepak.co.nz/EzePak_Brochure.pdf, Copyright Notice 2007.

Bigfrig.com downloaded from URL https://bigfrig.com/shop/coolers/cross-five-cattle-coolers/3-holster-cross-five-cattle-cooler/ on Jul. 10, 2024 but believed to be available earlier based on availability at the Wayback Machine Internet Archive showing availability in Mar. 2023 and earlier (attached separately).

Think Livestock Product Catalogue 2019.

* cited by examiner

HOLDER FOR VACCINE GUNS

CROSS REFERENCE TO RELATED APPLICATIONS

This application claims the priority benefit of U.S. Provisional Patent Application No. 63/531,529 filed Aug. 8, 2023 for "Holder for Vaccine Guns" of Seth Joseph Davis, hereby incorporated by reference in its entirety as though fully set forth herein.

BACKGROUND

Livestock handlers often have to perform multiple operations, such as banding, tagging, branding, and vaccinating. These must be performed very quickly while working livestock. Due to a lack of help it is often necessary for one or two people to perform all of those operations without assistance. Some of the tools, such as the tagger and bander, can be fairly easily placed in one's pockets to free up the hands for other operations. Other tools, such as the branding iron and vaccine gun, are much more difficult to keep close at hand while performing other operations.

Oftentimes, the person doing the work has to return to a staging area and exchange tools between each operation. This increases the time that livestock has to be restrained, and leads to extra stress on the animals. Livestock handlers may also conscript the help of small children or the elderly to serve as tool holders. This can place small children and the elderly in potentially dangerous situations that they lack the awareness or physical ability to respond to. It is desirable therefore to have a better method of holding tools that keeps the tools within easy reach for fast change over between operations while not exposing anyone to a dangerous environment.

DETAILED DESCRIPTION

The present invention seeks to provide a solution to this problem specifically as it relates to livestock vaccinations, by providing a holster or holder for safely storing the vaccination or vaccine gun on the livestock handler's person while it is not in use. The holder for vaccine guns allows the livestock handler to keep their hands free for other operations while also maintaining quick access to the vaccine gun when it is needed, without having to return to the staging area or enlist the help of others.

The device of the present disclosure may be used to safely secure vaccine guns about the person or user/operator, allowing the user to have their hands free for other jobs. Generally, the holder for vaccine guns may include a securing mechanism for the vaccine gun. The holder for vaccine guns may also include a needle protection mechanism to protect the user from accidental injection. The holder for vaccine guns may also include a leg strap for stability while the holder is worn. The holder for vaccine guns may also include a reversing mechanism for ambidextrous use. The holder for vaccine guns may also include a modular holding mechanism to accommodate different models of vaccine guns.

In an example, the holder for vaccine guns includes a base member for attaching to a side of a person. The example holder for vaccine guns also includes a mounting plate attached to the base member. The mounting plate has a receiving channel. The example holder for vaccine guns also includes an interchangeable sleeve configured to receive at least a portion of a first vaccine gun therein. The interchangeable sleeve engages with the receiving channel of the mounting plate to releasably mount the sleeve to the mounting plate. The interchangeable sleeve is removable from the mounting plate for replacement with a different sleeve for a second vaccine gun. The second vaccine gun can be a different type from the first vaccine gun so that the holder can be implemented with a variety of different types of vaccine guns.

The vaccine gun holder may have any suitable shape and/or other configuration that allows for the safe storage of, and quick access to the vaccine gun. The vaccine gun holder may be located at any convenient and safely accessible point on the livestock handler's person (e.g., strapped to the user's thigh and/or belt or waistband). However, the holder may be located anywhere on or near the user where it can be safely and conveniently accessed.

Before continuing, it is noted that as used herein, the terms "includes" and "including" mean, but is not limited to, "includes" or "including" and "includes at least" or "including at least." The term "based on" means "based on" and "based at least in part on."

In addition, the devices and operations shown and described herein are provided to illustrate example implementations. It is noted that the devices and operations are not limited to those shown. Still other devices and operations may also be implemented.

Figure 1:
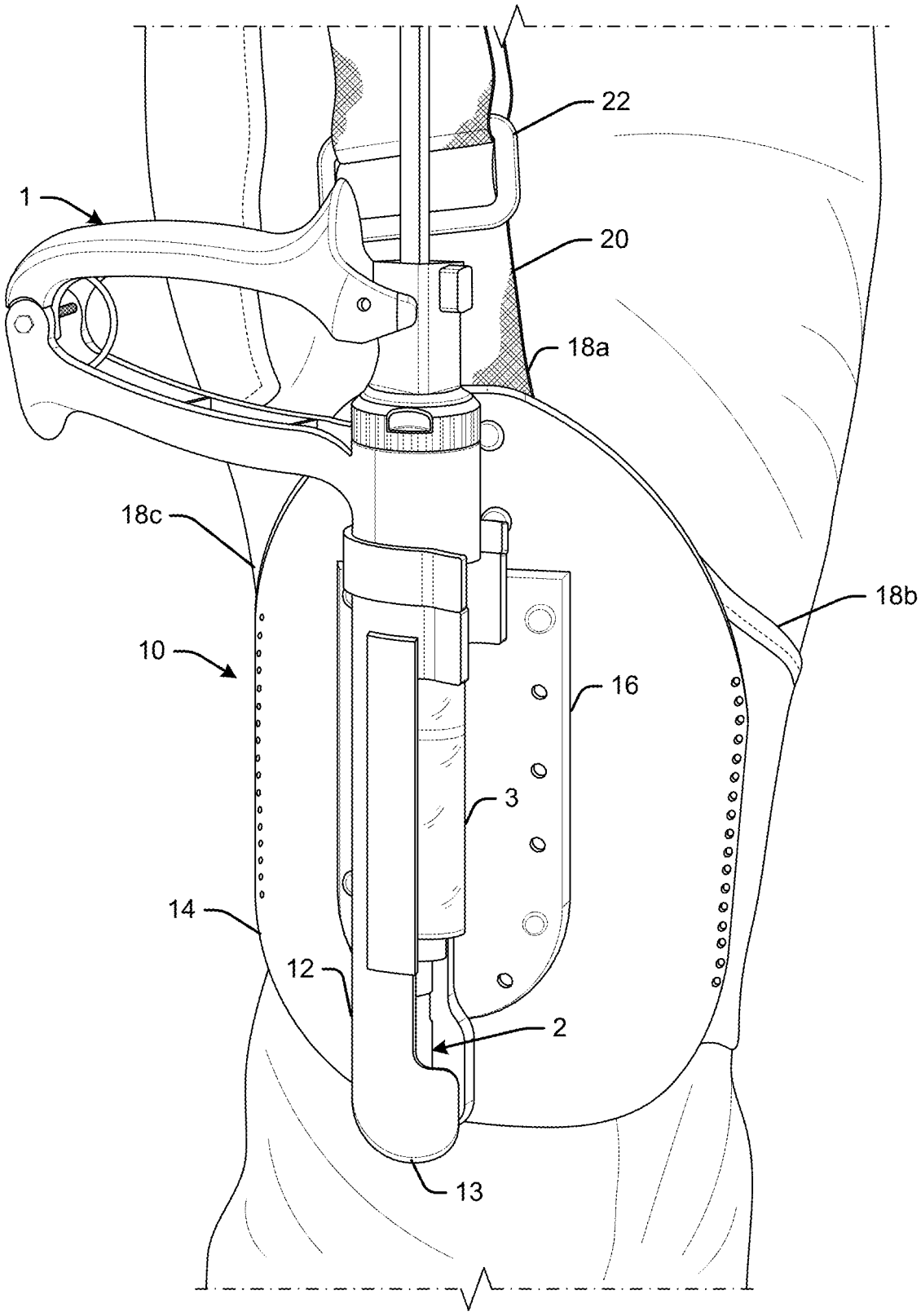
FIGS. 1-3 show an example holder for vaccine guns as it may be attached to the thigh of a person.
Figure 2:
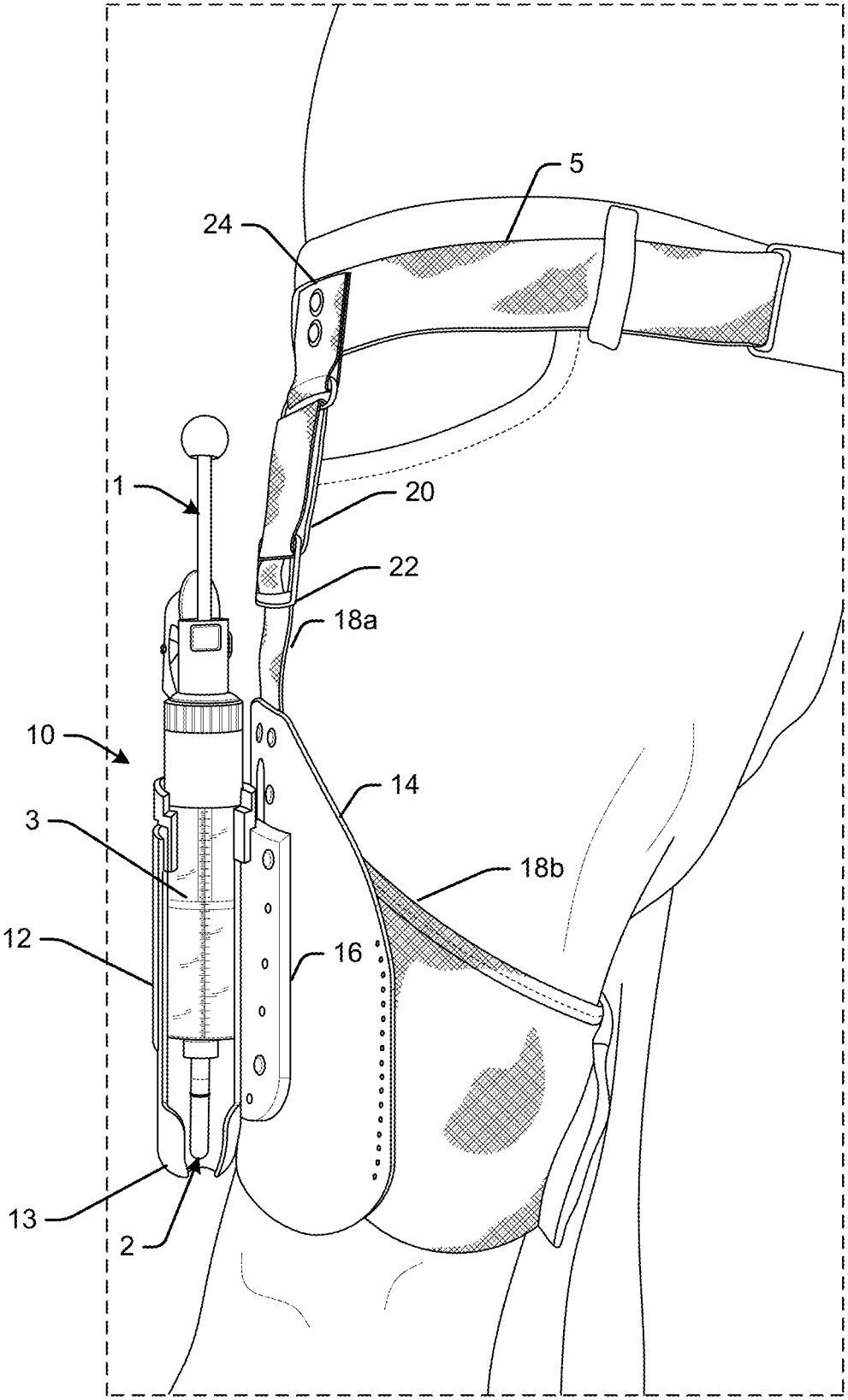
Figure 3:
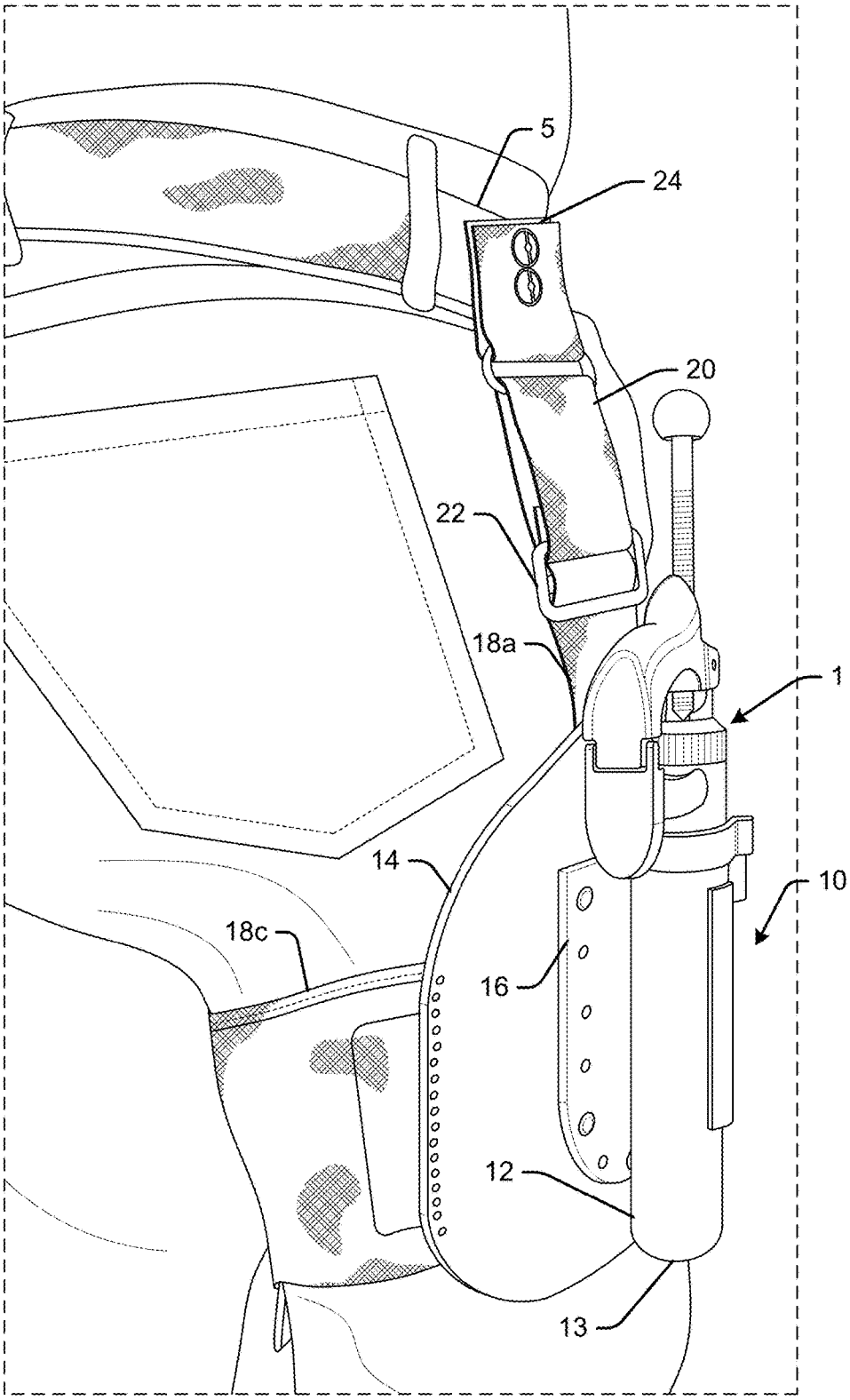

FIGS. 1-3 show an example holder 10 for vaccine guns 1 as it may be attached to the thigh of a person. An example holder for vaccine guns includes a mechanism (e.g., sleeve 12) for securing the vaccine gun 1 in the holder 10. A mechanism (e.g., base member 14) is provided for protecting the user from the vaccine gun needle 2 when withdrawing and inserting the vaccine gun 1 in the holder 10. A mechanism (e.g., mounting plate 16) is provided to removably attach the sleeve 12 to the base member 14. A mechanism (e.g., covered end 13 of the sleeve 12) is also provided for protecting the user from the needle 2 for example, to prevent accidental injury when the user reaches below the vaccine gun 1. A mechanism (e.g., straps 18*a-c*) are provided for securing the holder 10 to the user's body, such as to the user's thigh and/or waist as shown.

The example holder 10 for vaccine gun 1 includes a sleeve 12 to receive the barrel 3 of the vaccine gun 1. The vaccine gun 1 shown by way of example in FIGS. 1-3 is an ALLFLEX™ model MR2 vaccine gun, though the device is not limited to use with any particular type, brand, or configuration of vaccine gun.

The sleeve 12 is configured to retain the vaccine gun 1 in a frictional fit. It will be clear and apparent to one skilled in the art, after becoming familiar with the teachings herein, that a friction fit is not the only possible way to secure a vaccine gun in a sleeve. The sleeve 12 can also be adapted for any of several securing methods. Examples include, but are not limited to, magnets, clamps, latches, straps and other mechanisms now known or later developed. Furthermore, multiple securing mechanisms may be employed at the same time (e.g., friction fit and a strap). In another example, a frictional fit material may be provided on the barrel 3 of the vaccine gun 1 itself, instead of, or in addition to being provided in the interior of the sleeve 12.

Figure 13:
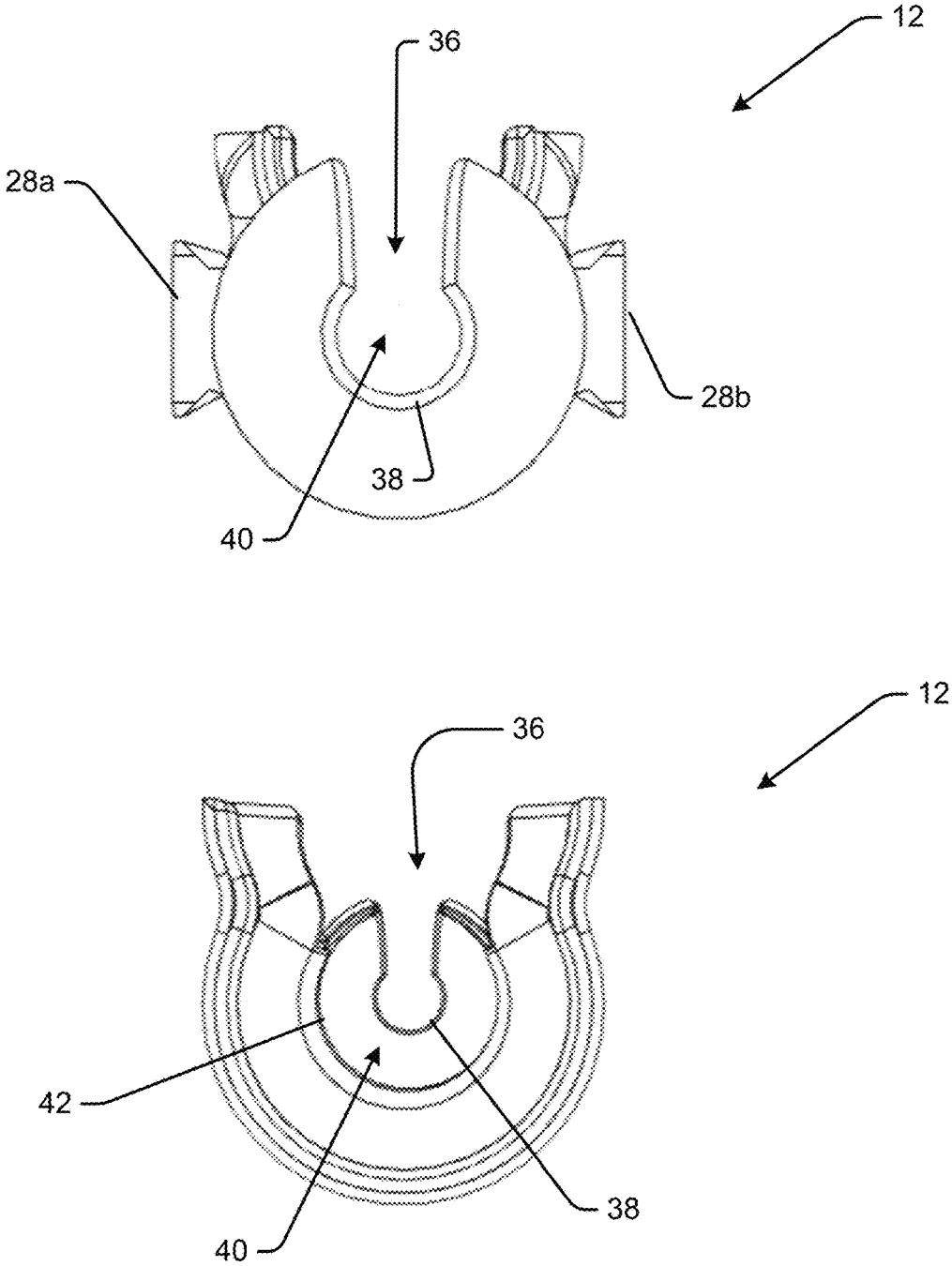
FIGS. 13-15 are various side views of a sleeve of the example holder for vaccine guns.

In the example shown, the friction fit material is provided on less than half the length of each sleeve 12 (e.g., lining 42 shown in FIG. 13). This was found to provide sufficient gripping force while still enabling the user to readily insert and withdraw the vaccine gun 10 from the sleeve 12. While this length of friction fit material was found to be sufficient, more or less of each sleeve 12 may be covered with friction fit material depending on the vaccine gun 1 being stored, user preferences, etc.

In the example shown, the vaccine gun 1 is secured vertically. However, other device configurations (e.g., angular or perpendicular orientations) are also contemplated and the device is not restricted to any particular orientation of securing the vaccine gun relative to the user's body.

In the example shown, the vaccine gun 1 is shown secured to the user's right thigh. However, it is also possible to release the sleeve catch or tab member, take the sleeve mounting rails out of the sleeve guide, and reverse the sleeve on the sleeve mounting plate so that it can be worn on either the right or left side of the user's body.

It is understood that the holder 10 can be manufactured of any suitable materials, including but not limited to, plastic, metal, leather, and fabric(s). In addition, while the examples shown are constructed by assembling separate component parts together to form the holder 10, it will be appreciated that some or all of the device components may be constructed together through various manufacturing processes, including, but not limited to, plastic injection molding and casting.

Figure 4:
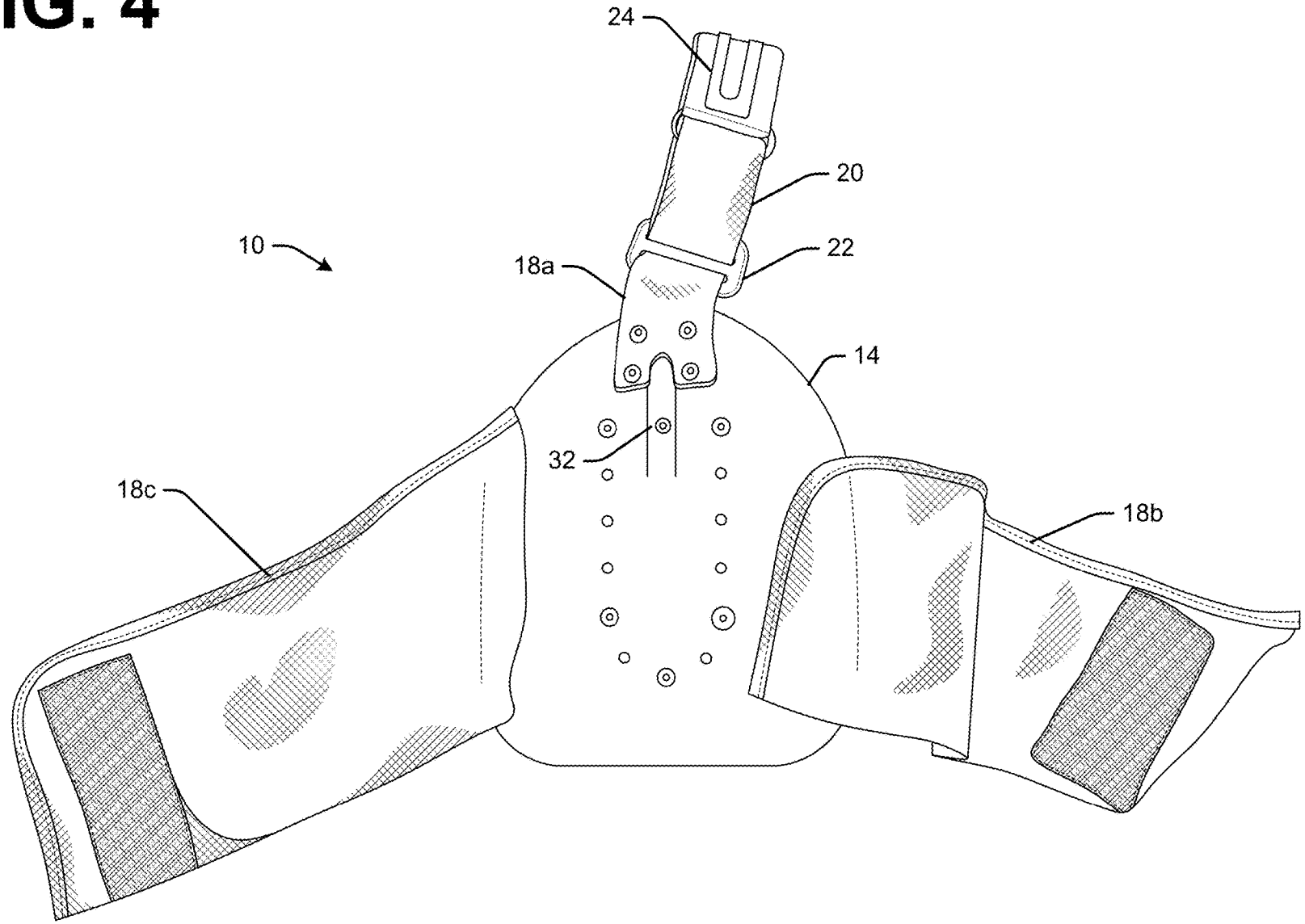
FIG. 4 shows a back side view of the example holder for vaccine guns.
Figure 5:
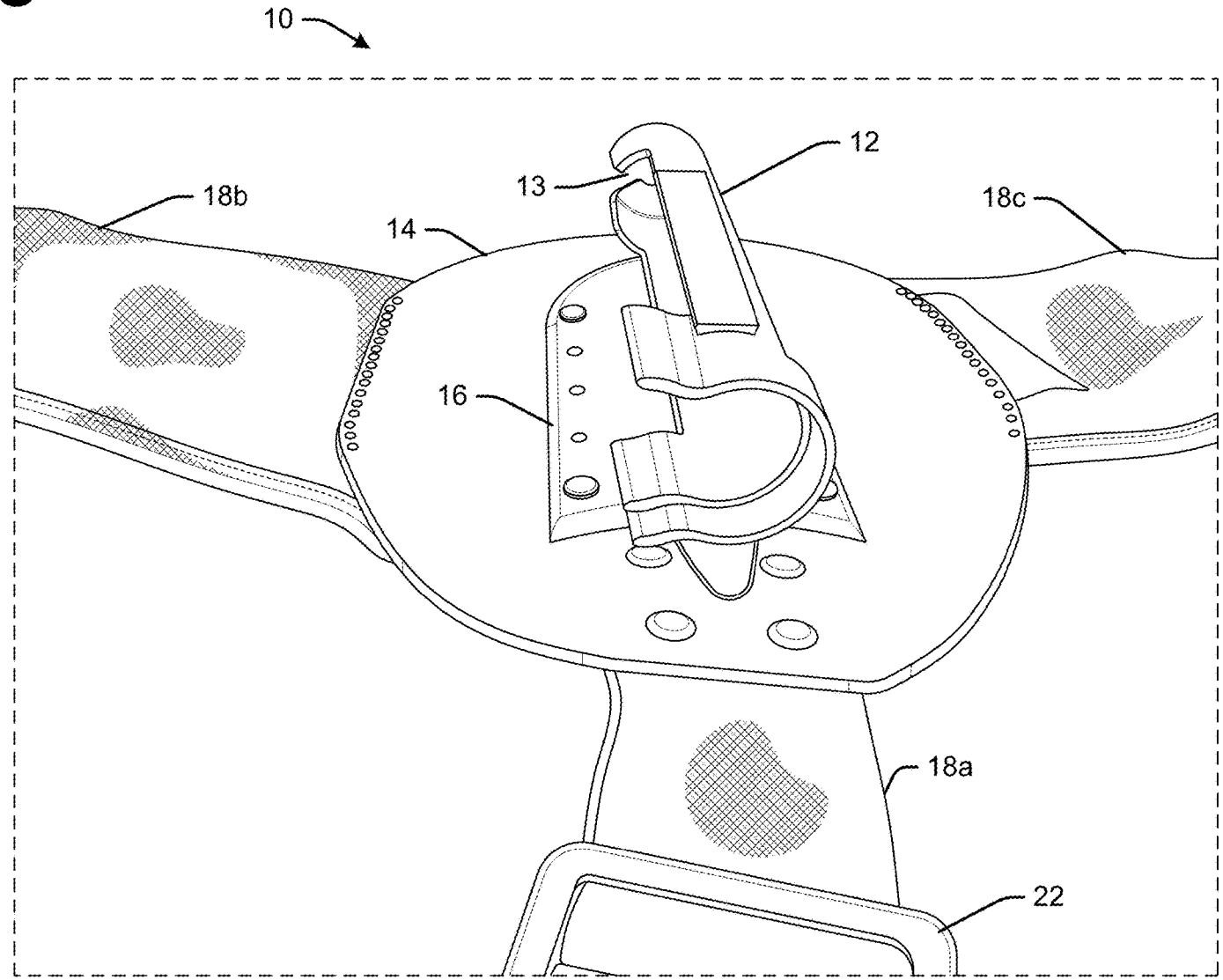
FIG. 5 shows a front side view of the example holder for vaccine guns.
Figure 6:
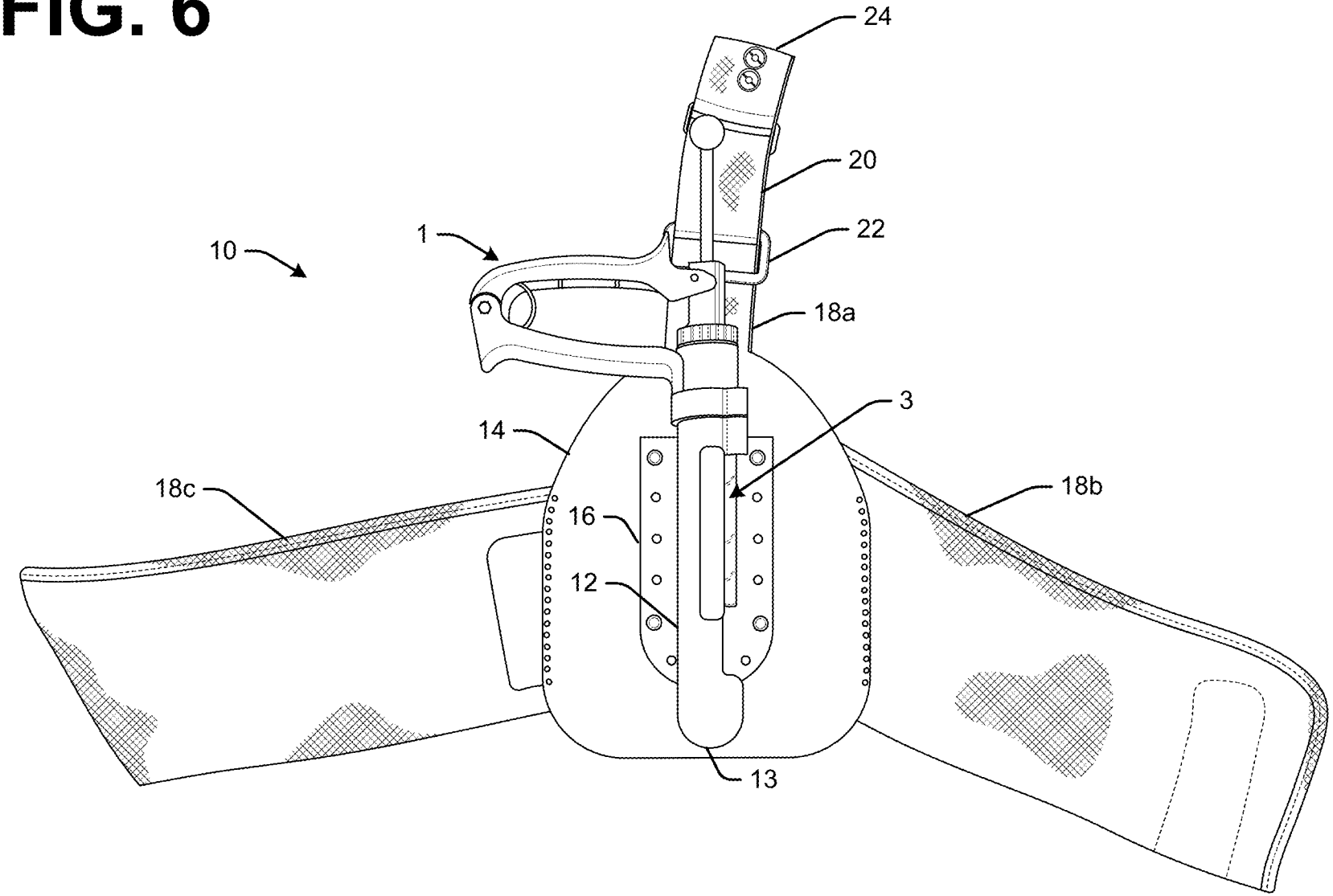
FIG. 6 shows a front side view of the example holder for vaccine guns with a vaccine gun.

FIG. 4 shows a back side view of the example holder 10 for vaccine guns. FIG. 5 shows a front side view of the example holder 10 for vaccine guns. FIG. 6 shows a front side view of the example holder 10 for vaccine guns with a vaccine gun 1. The holder 10 may include strap 18*a* for connection to the user's waist (e.g., waistband of the pants or belt 5), and thigh strap(s) 18*b* and 18*c*. The holder 10 may also include support strap 20 with length adjustment buckle 22, and belt clip 24.

The leg or thigh strap(s) 18*b*, 18*c* are connected (e.g., by sewing and/or glue) to the base member 14, and wrap around and secure the base member 14 to the thigh of the person. A support strap 18*a* can also be connected to the base member 14. The support strap 18*a* may be adjustable in length. The support strap 18*a* may also have a clip for attaching to a waistband or belt 5 worn by the person.

In an example, the thigh strap(s) 18*b* and 18*c* are made out of a stretchable, breathable double-sided material having hook-and-loop fasteners (e.g., VELCRO™), because this was found to give the best grip to keep the apparatus secure during vigorous use.

In an example, the straps 18*b* and 18*c* have hook-and-loop fasteners on both sides, so that it does not matter which strap is on top when the user is securing the device around their thigh. This makes putting the device on much simpler for the user. However, there are other methods that can be used to secure the device to the user's thigh, including but not limited to buckles. Furthermore, the thigh straps 18*b* and 18*c* may be angled in order to give a more secure fit around the leg and to help keep the user's pants from riding up during use.

Figure 7:
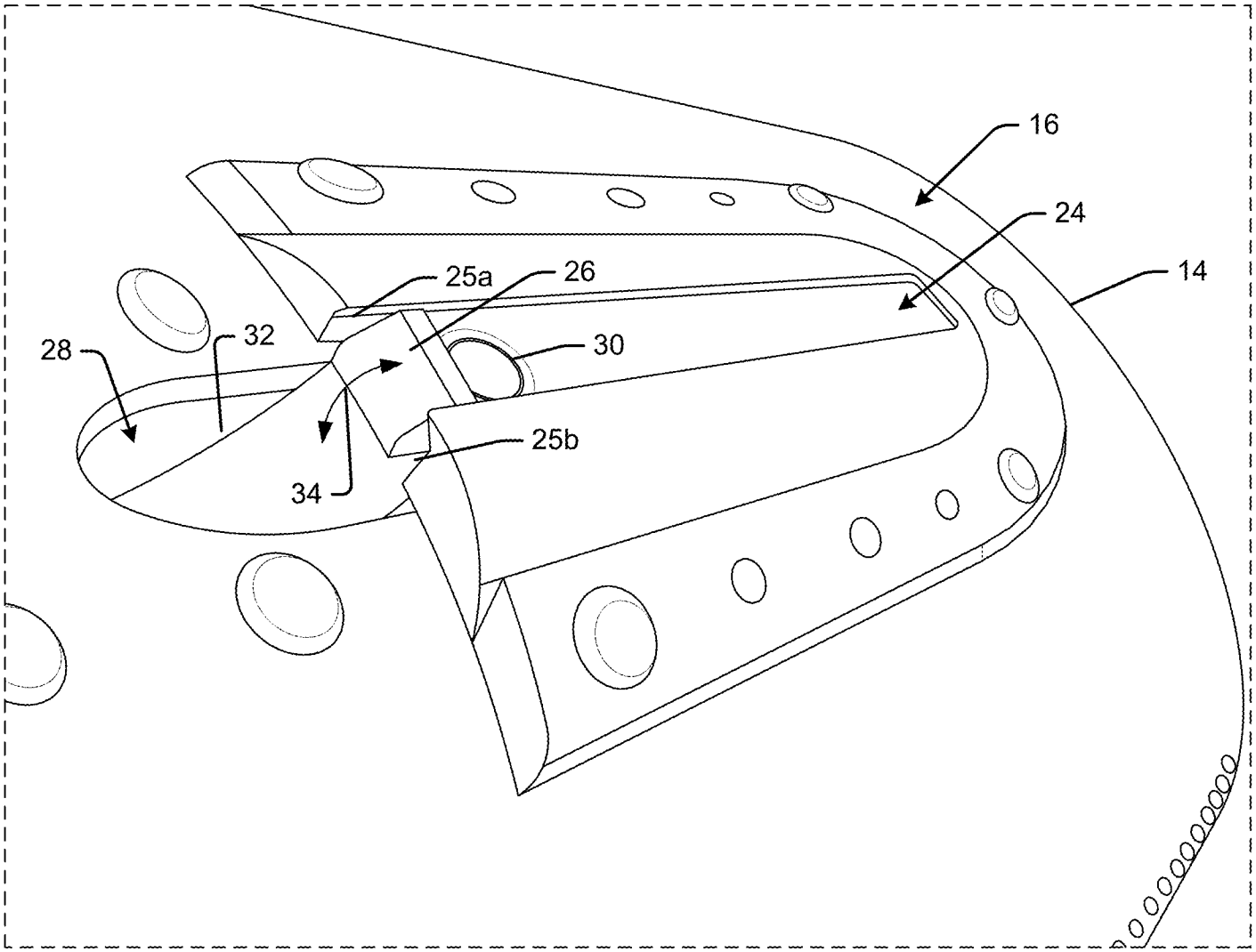
FIG. 7 shows the mounting plate attached to a base member of the example holder for vaccine guns.
Figure 8:
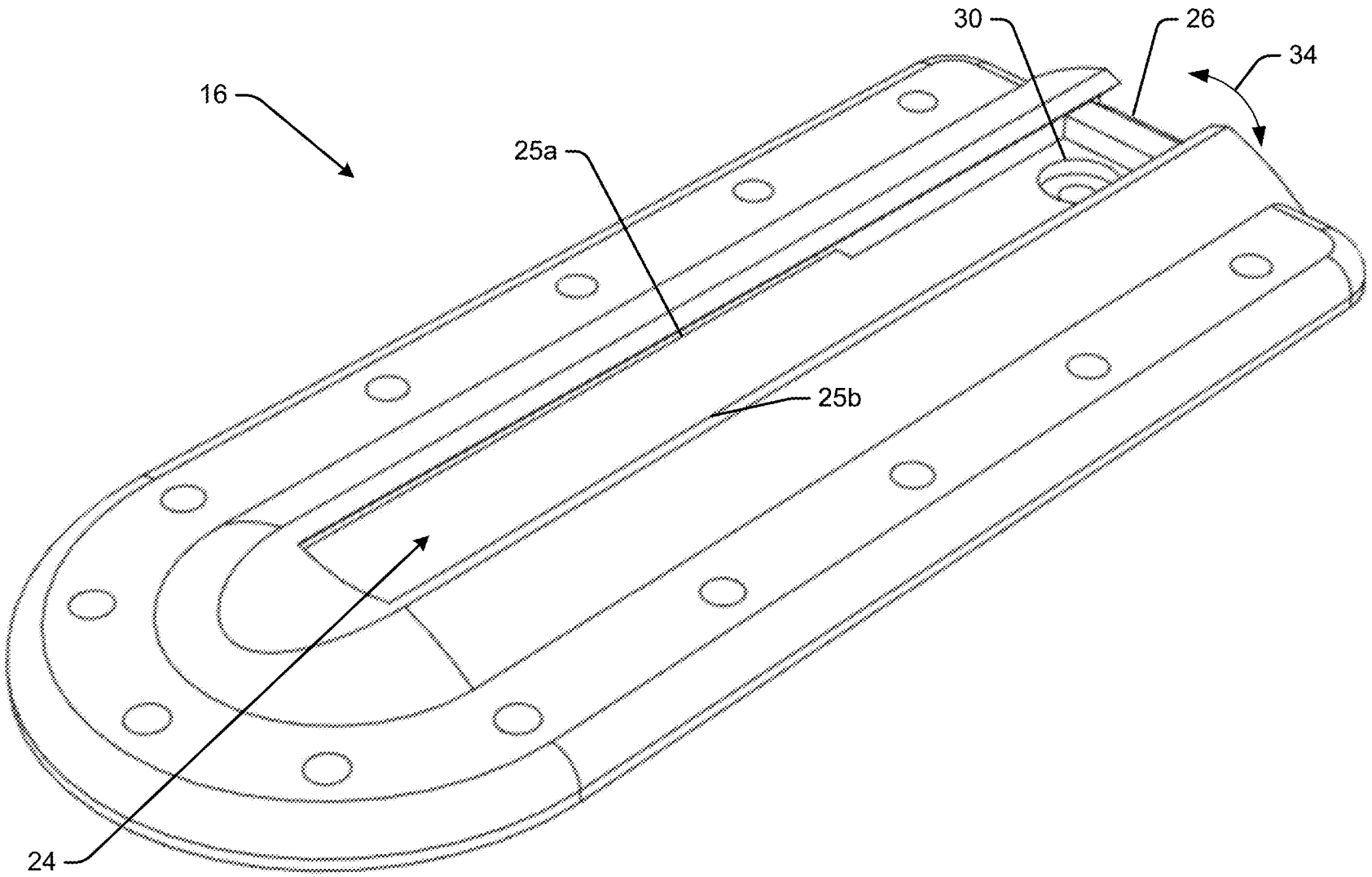
FIGS. 8-10 are various isometric views of the mounting plate of the example holder for vaccine guns as shown in FIG. 7.
Figure 9:
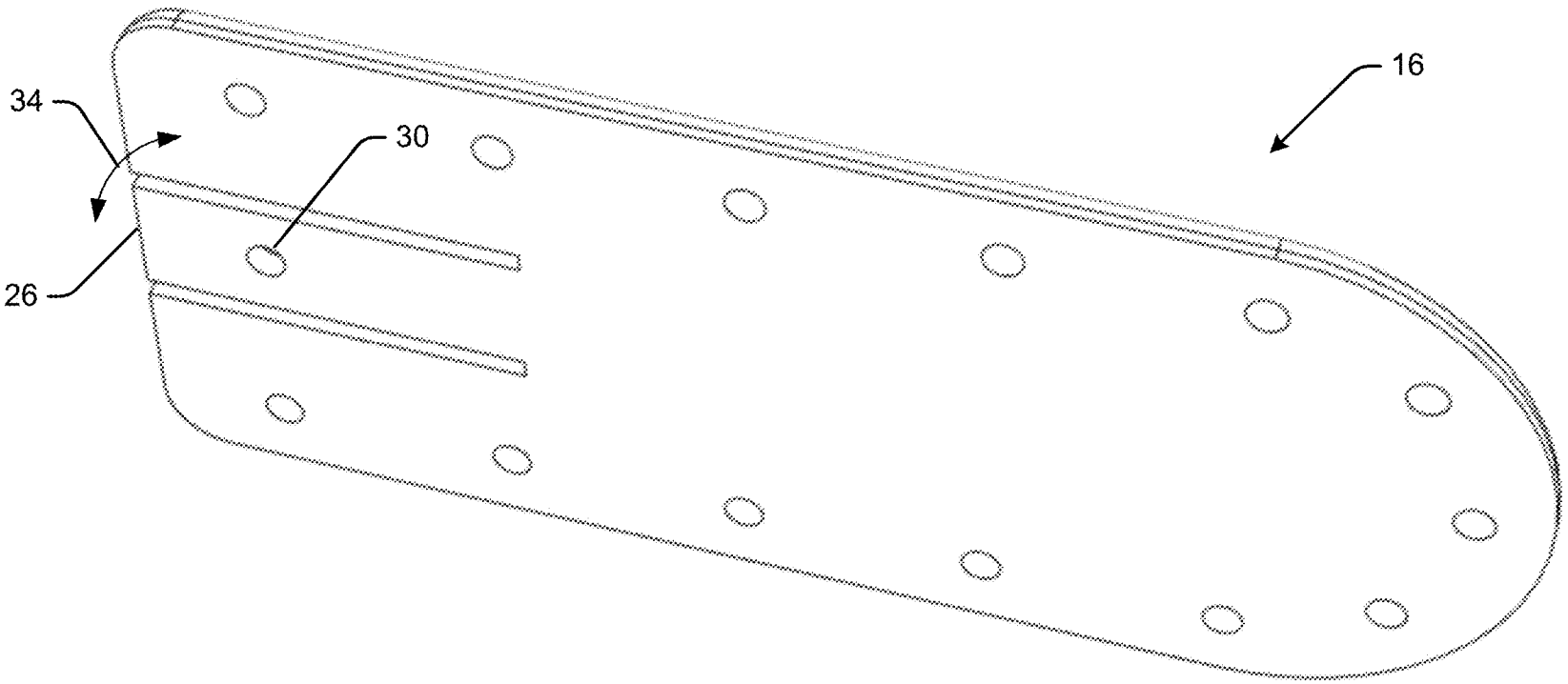
Figure 10:
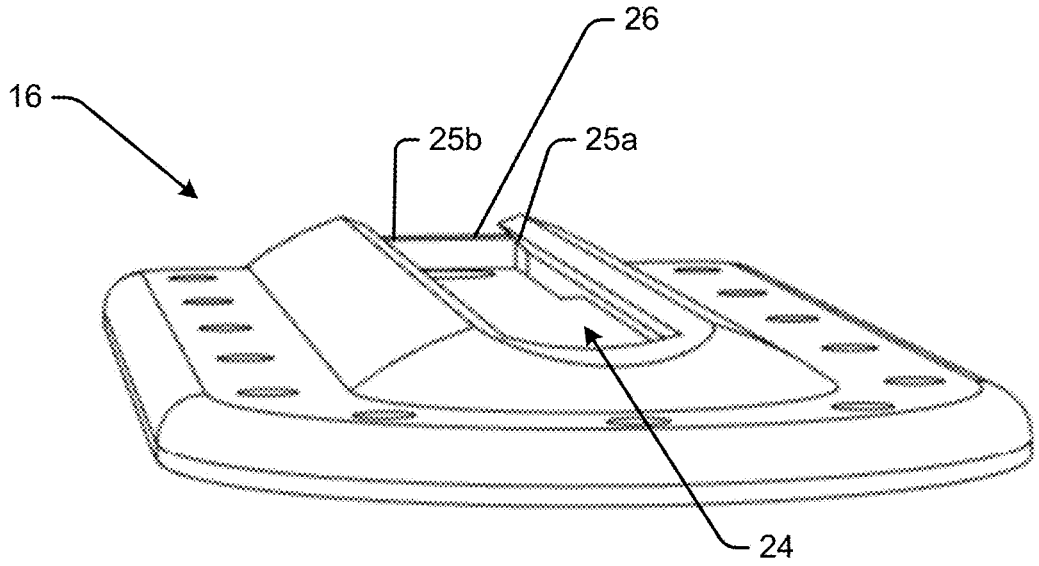
Figure 10:
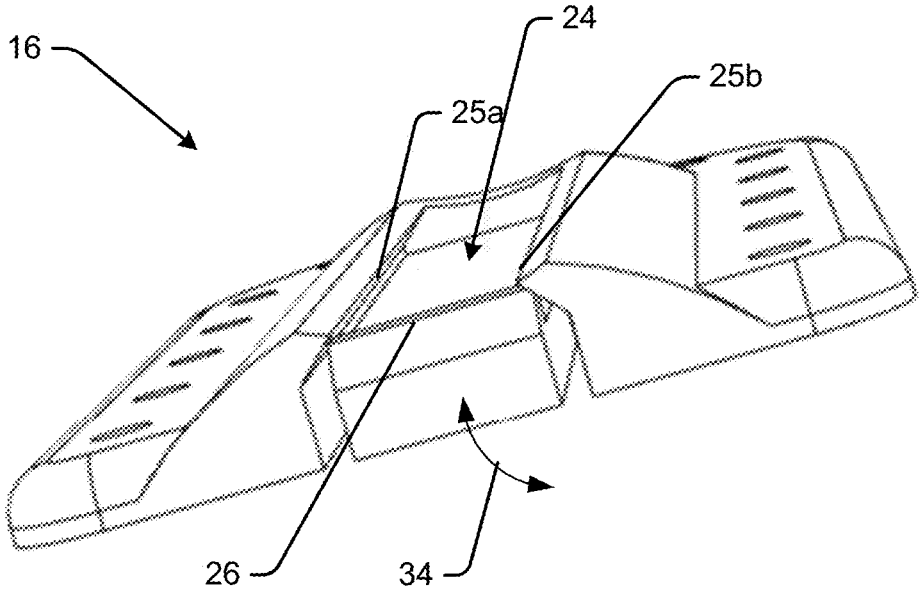

FIG. 7 shows the mounting plate 16 attached to a base member 14 of the example holder 10 for vaccine guns. FIGS. 8-10 are various isometric views of the mounting plate 16 of the example holder 10 for vaccine guns as shown in FIG. 7.

The example holder 10 for vaccine guns includes the base member 14 for attaching to a side of a person, and a mounting plate 16 attached to the base member 14. The mounting plate 16 has a receiving channel 24 for the interchangeable sleeve 12 configured for holding the vaccine gun 1. The interchangeable sleeve 12 engages with the receiving channel 24 of the mounting plate 16 to releasably mount the sleeve 12 to the mounting plate 16. The interchangeable sleeve 12 is removable from the mounting plate 16 for replacement with a different sleeve (e.g., FIGS. 20-25) for a second, different type of vaccine gun.

In an example, the example holder 10 includes a tab member 26 on the mounting plate 16. The tab member 26 is operable to move between a raised position and a depressed position. The tab member is biased or tends toward the raised position (e.g., as seen in FIG. 7), and can be manually moved or pressed into the depressed position for inserting the interchangeable sleeve 12 into the channel 24 of the mounting plate 16. Upon inserting the sleeve 12, the tab member 26 is biased and thus returns at least partially to the raised position to retain the sleeve 12 in a fixed position within the receiving channel 24 of the mounting plate 16. The tab member 26 can be at least partially depressed (e.g., by the user's finger) to release and then remove the sleeve 12 from the receiving channel 24 of the mounting plate 16.

In an example, the tab member 26 is mounted adjacent to a cutout or opening 28 formed through the base member 14. This enables ready movement of the tab member 26 into the depressed position.

In an example, the tab member 26 is formed on a portion of the receiving channel 24, as best seen in FIG. 9. The tab member 26 may also be secured (e.g., by rivet 30) to the portion 32 of the base member 14 that forms the opening 28 therethrough. The portion of the bottom of the receiving channel 24 having the tab member 26 is separated from the mounting plate 16 on each side so that the portion of the bottom of the receiving channel 24 having the tab member 26 moves up and down (e.g., as illustrated by arrows 34) apart from the remainder of the mounting plate 16, thus enabling depressing and releasing the tab member 26 to retain and to release the sleeve 12 from the mounting plate 16, as described above.

Figure 11:
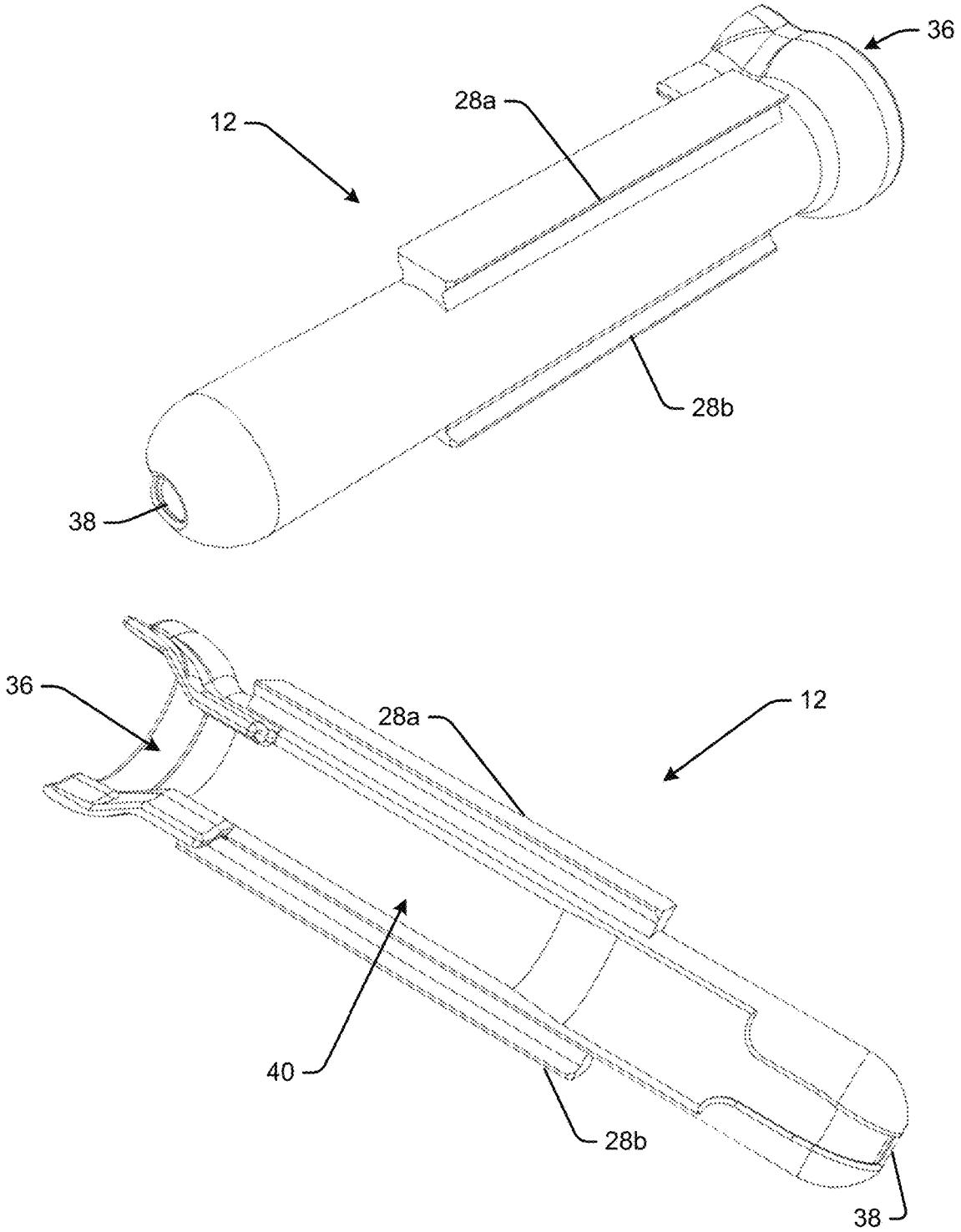
FIGS. 11-12 are various isometric views of a sleeve of the example holder for vaccine guns.
Figure 12:
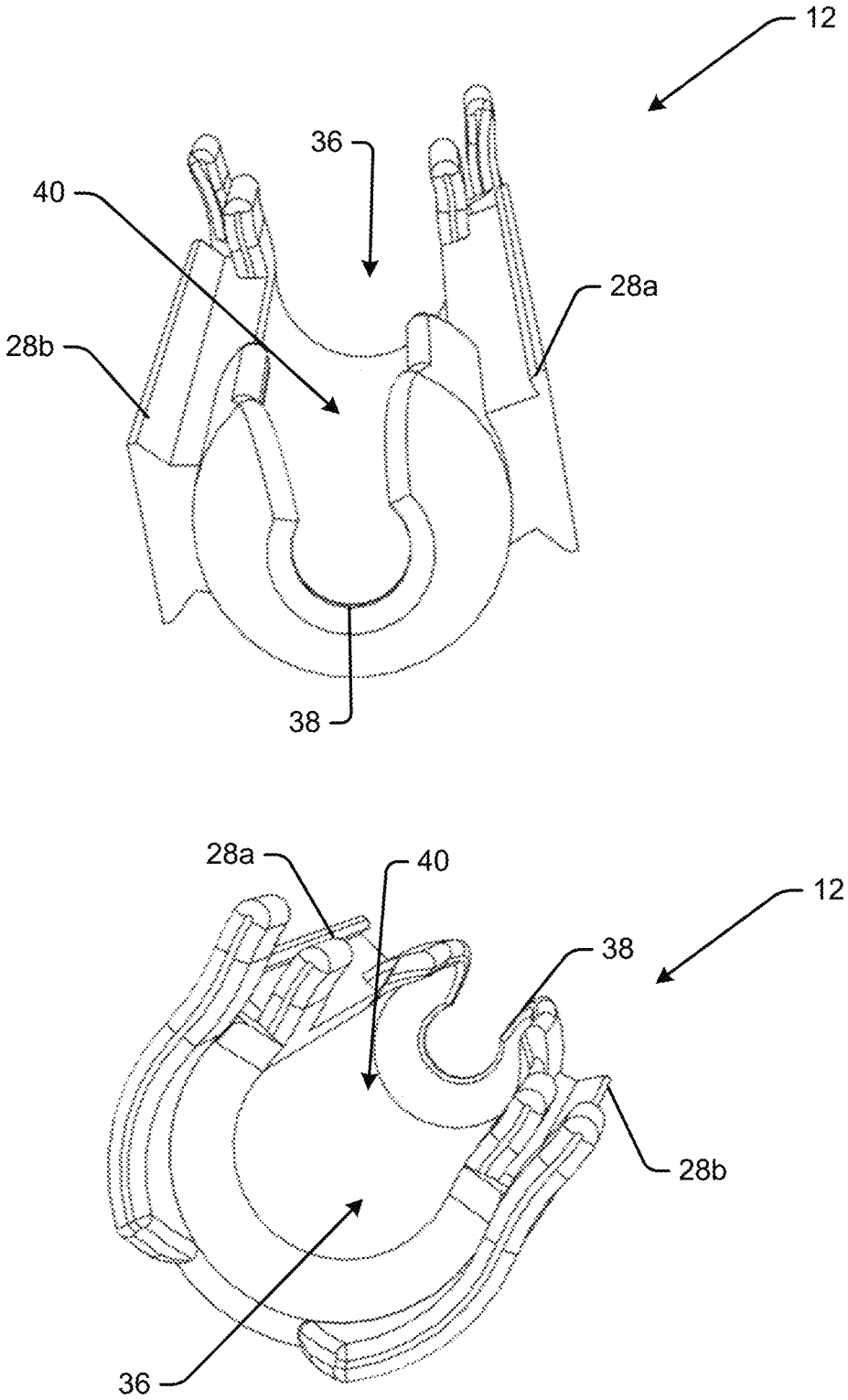
Figure 14:
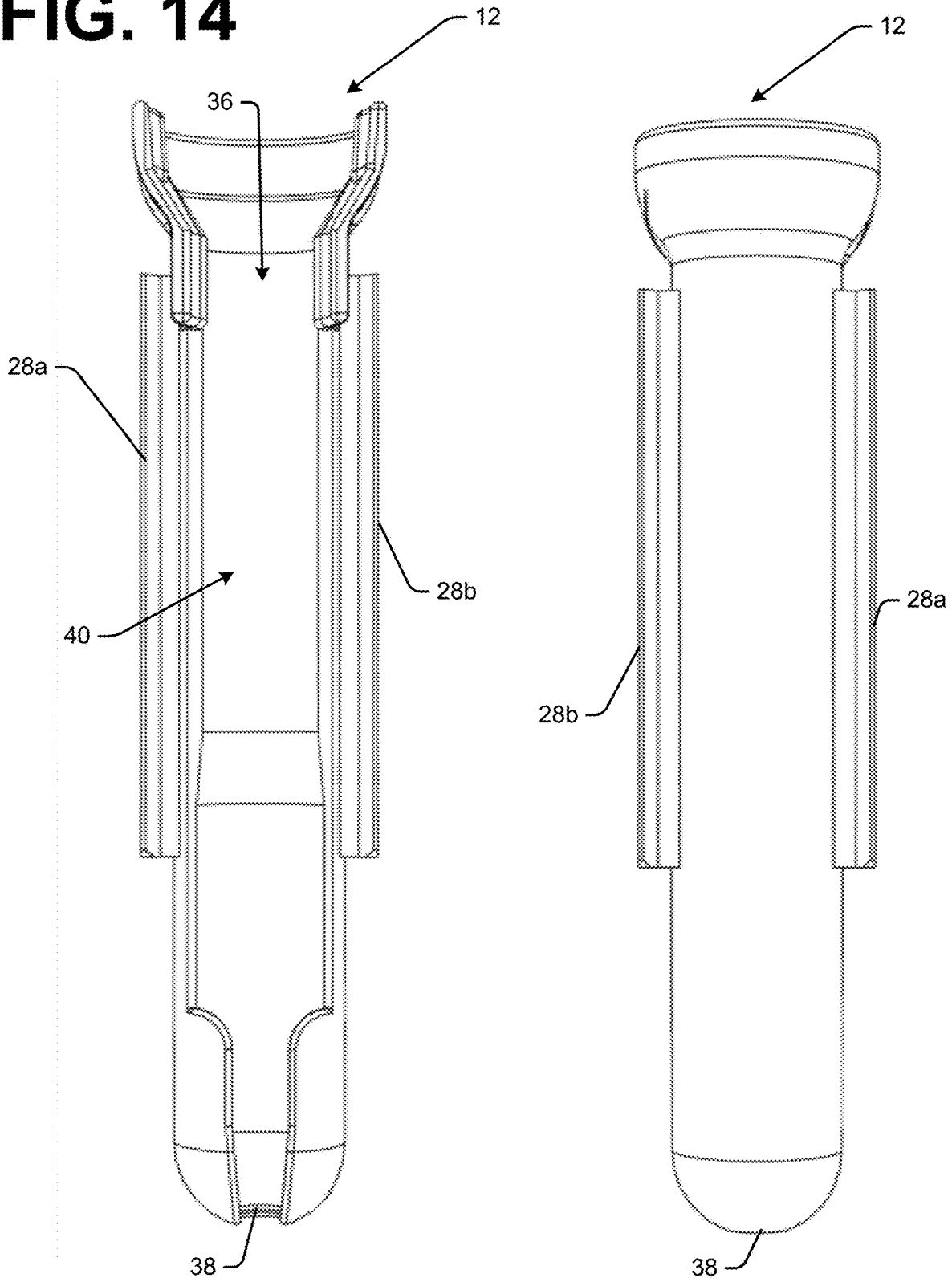
Figure 15:
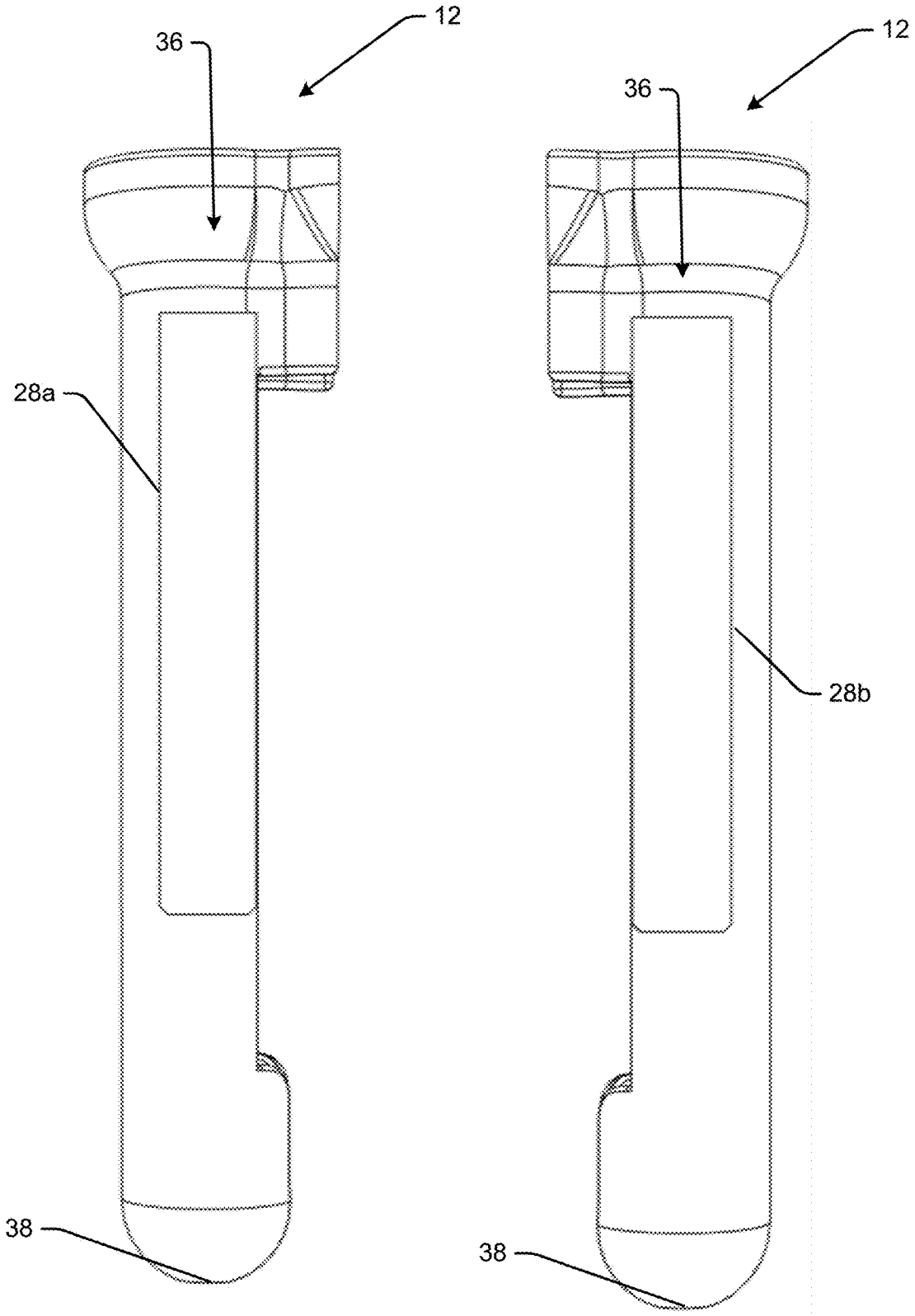
Figure 16:
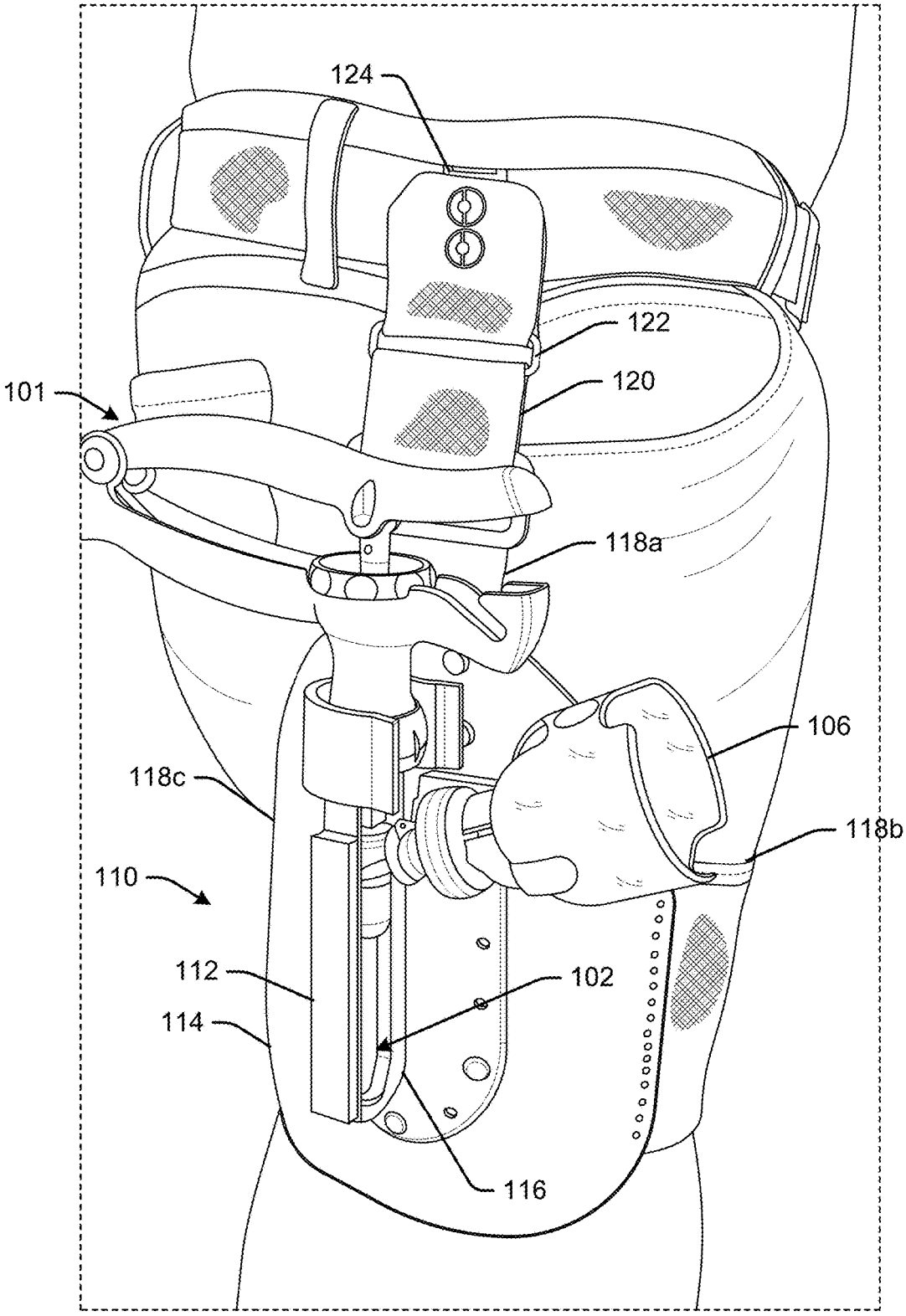
FIGS. 16-19 show another example holder for vaccine guns as it may be attached to the thigh of a person.
Figure 17:
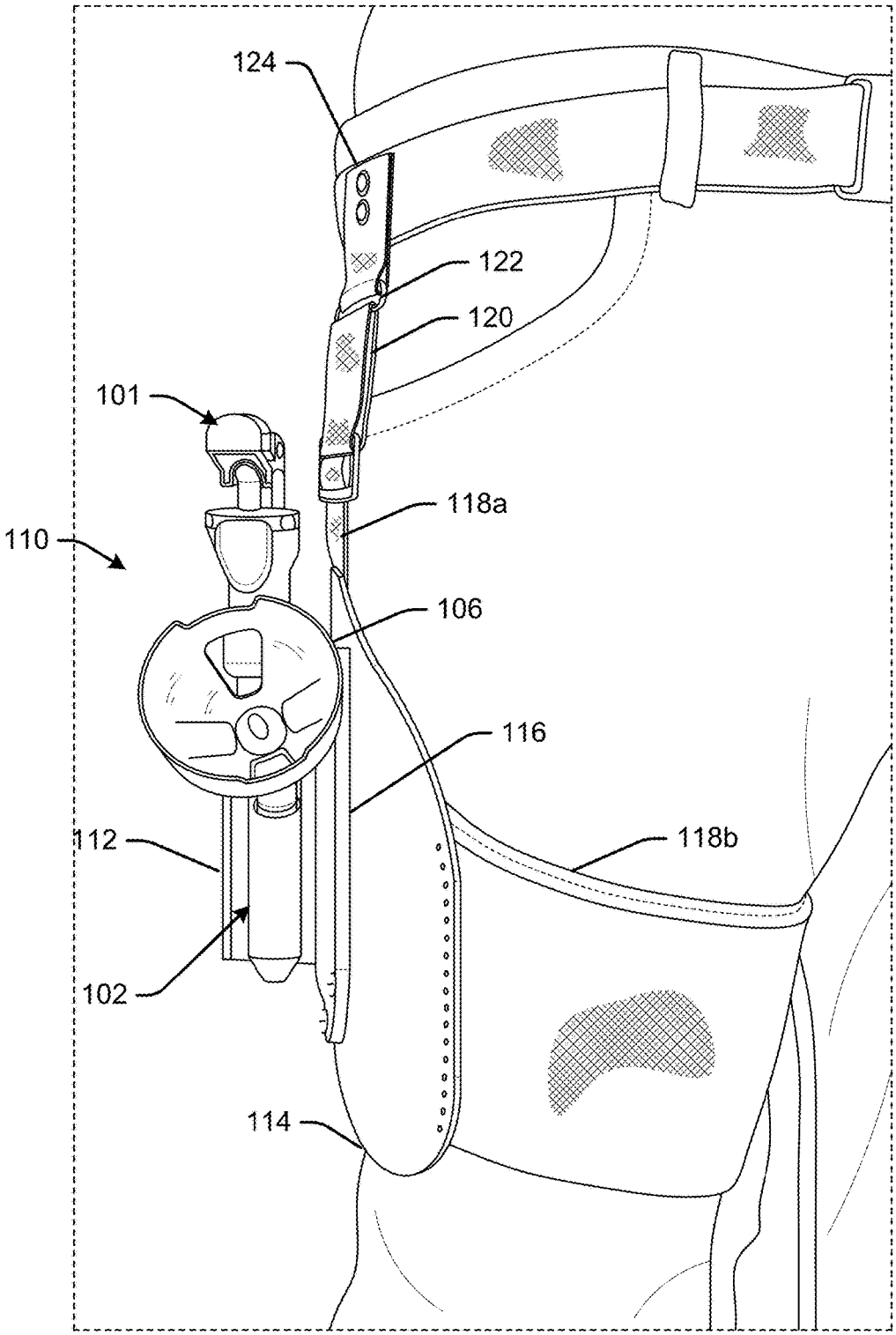
Figure 18:
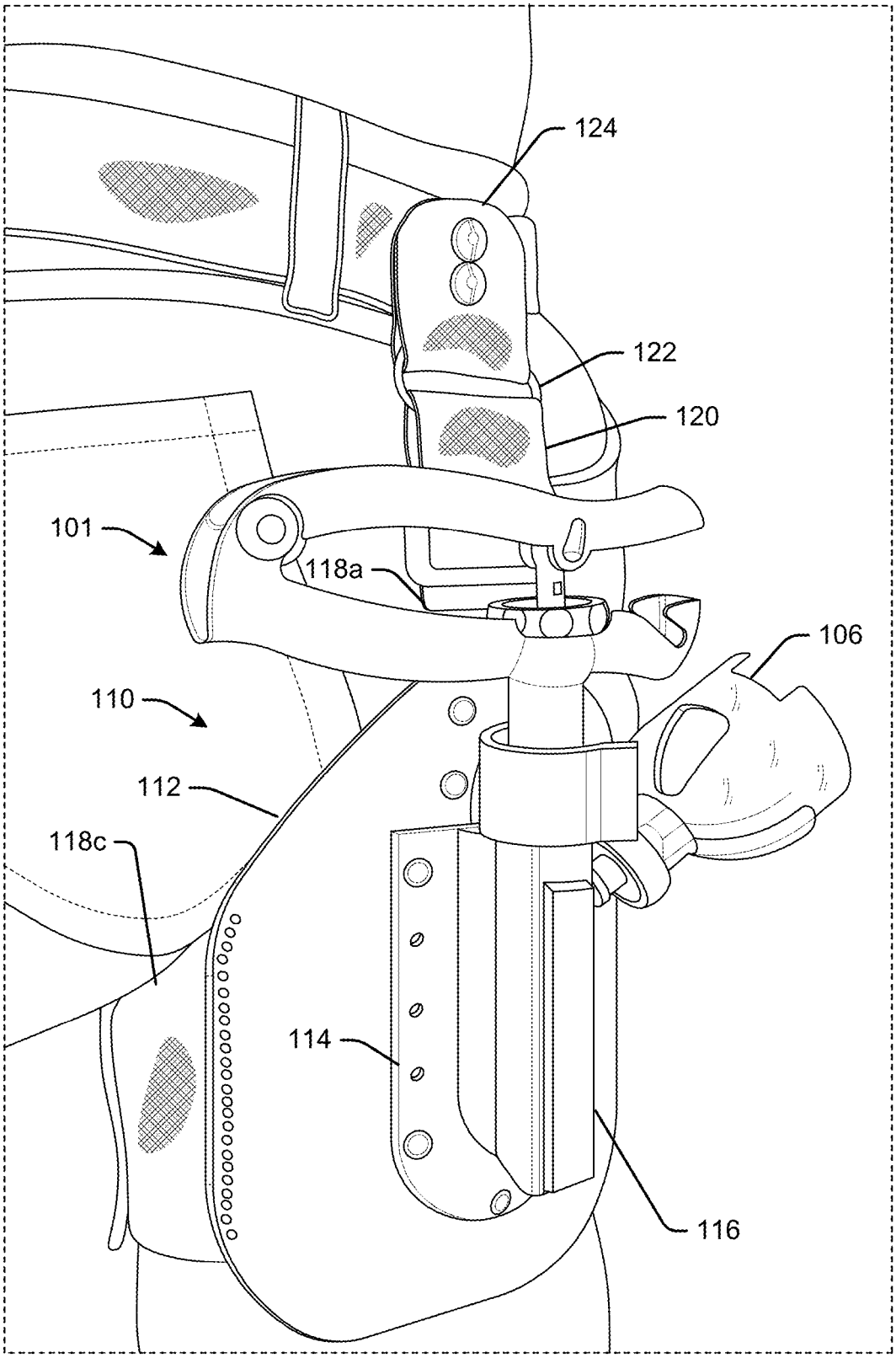
Figure 19:
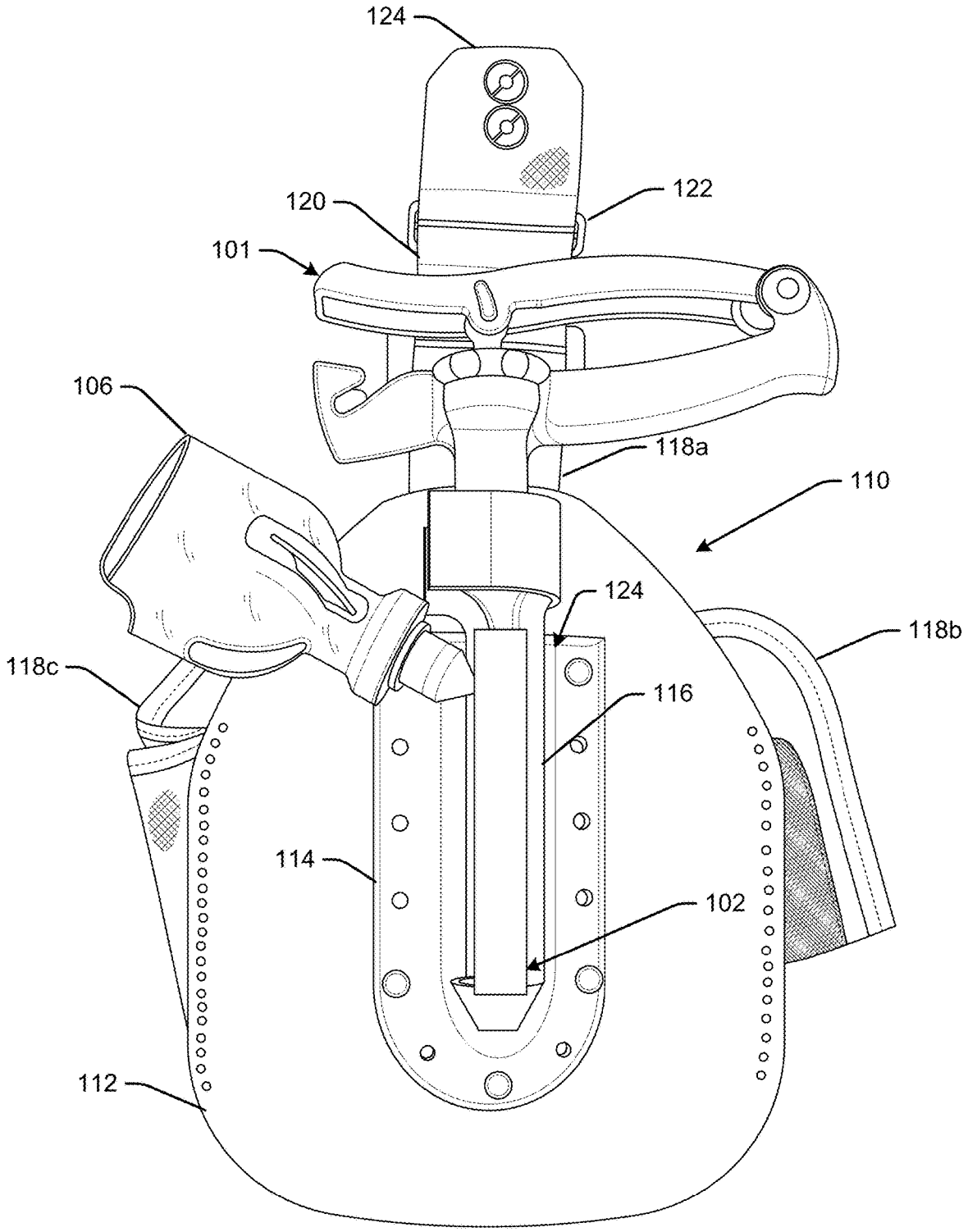

FIGS. 11-12 are various isometric views of a sleeve 12 which can be mounted in the mounting plate 16 of the example holder 10 for securing vaccine guns. FIGS. 13-15 are various side views of the sleeve 12 of the example holder 10 for vaccine guns.

In the example shown, the interchangeable sleeve 12 has a first end open 36 to receive the vaccine gun (e.g., vaccine gun 1) therein. The interchangeable sleeve 12 has a second partially closed end 13 to cover a needle 2 of the vaccine gun 1. An opening 38 can be formed on the second end of sleeve 12 and is configured as a drain opening to prevent fluid from accumulating in sleeve 12.

In an example, the receiving channel 24 of the mounting plate 16 has a first guide channel 25*a* on the first side of the receiving channel 24, and a second guide channel 25*b* on the second side of the receiving channel 24. The interchangeable sleeve 12 has a first rail member 28*a* on the first side of the sleeve 12, and a second rail member 28*b* on the second side of the sleeve 12. The first rail member 28*a* corresponds to and engages with or mates with the first guide channel 25*a* in the receiving channel 24 of the mounting plate 14. The second rail member 28*b* engages with or mates with the second guide channel 25*b* in the receiving channel 24 of the mounting plate 16.

In an example, the rails slide into the channels. However, in other examples the sleeve can be attached to the mounting plate in other ways, such as but not limited to, hook-and-loop (e.g., VELCRO™), magnets, or a twist lock, to name only a few examples for purposes of illustration. These and other examples will be readily apparent to those having ordinary skill in the art after becoming familiar with the teachings herein.

In an example, the interchangeable sleeve 12 also has an opening 40 formed along one side of the sleeve 12. This opening 40 enables the vaccine gun 1 to readily slide into the sleeve 12, for example, particularly when the vaccine gun has a reservoir (e.g., reservoir 106 shown in FIGS. 16-19)

As previously mentioned, and as shown best in FIG. 13, the interchangeable sleeve 12 may have a friction fit lining 42 along at least a portion of an interior of the interchangeable sleeve 12 to help better secure the vaccine gun 1 therein.

Figure 20:
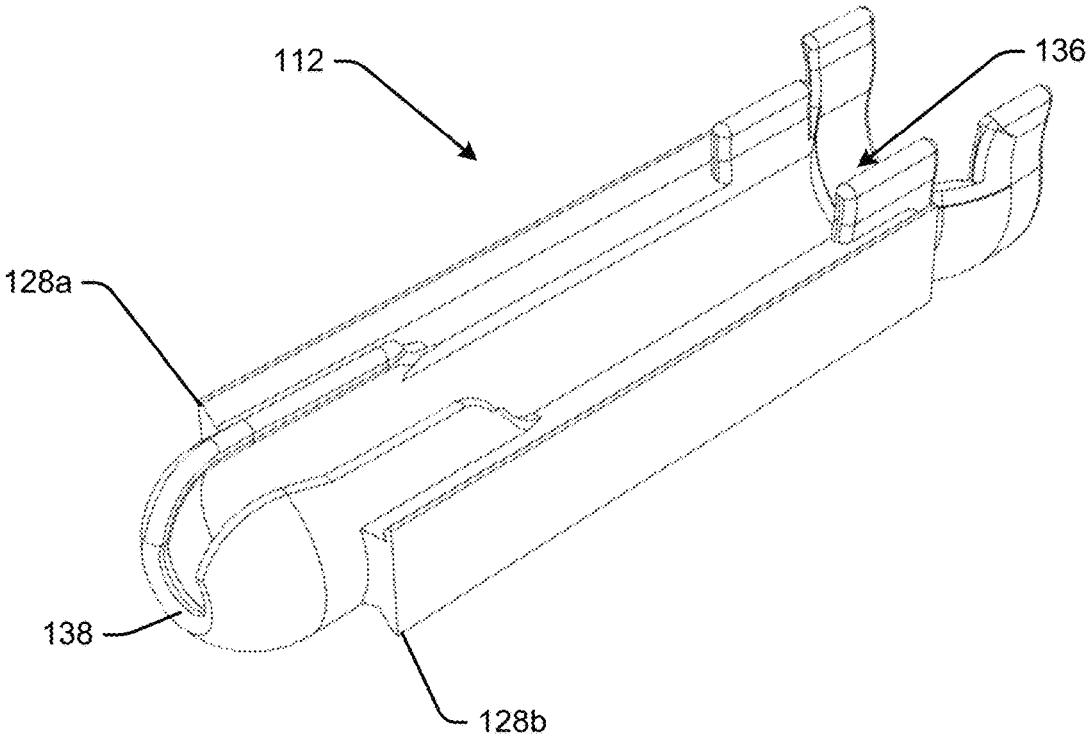
FIG. 20 are top and bottom isometric views of a sleeve of the example holder for vaccine guns as shown in FIGS. 16-19.
Figure 20:
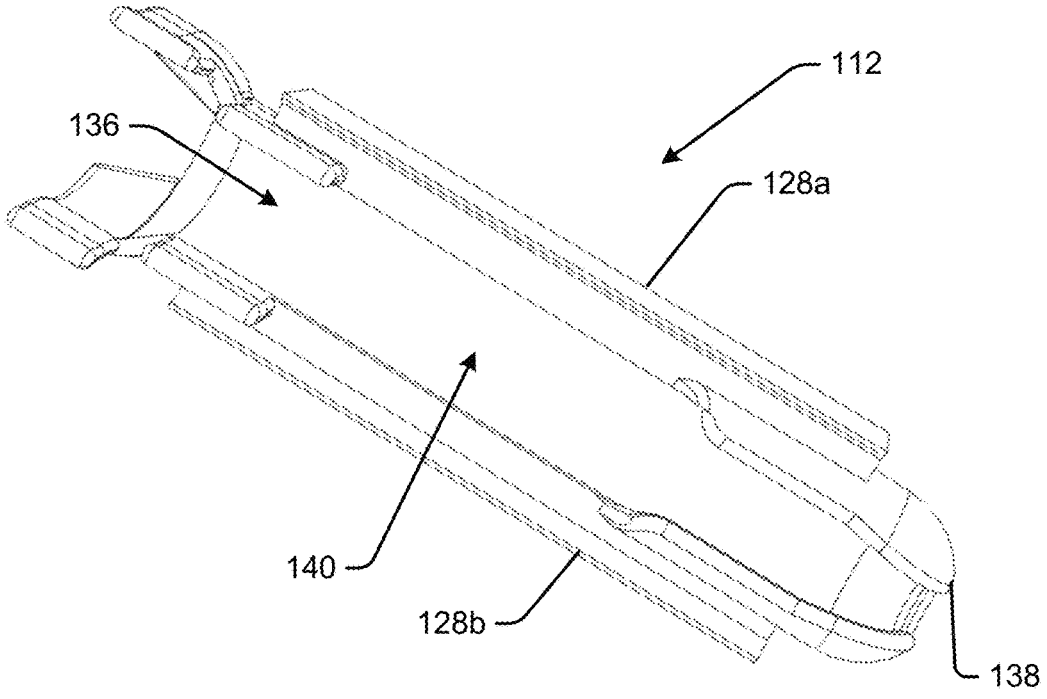
Figure 21:
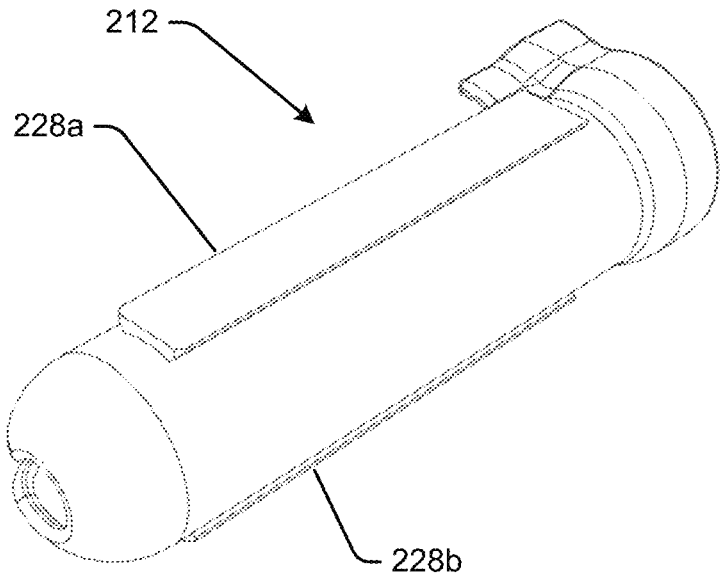
FIGS. 21-25 are top and bottom isometric views of other sleeves for the example holder for vaccine guns.
Figure 21:
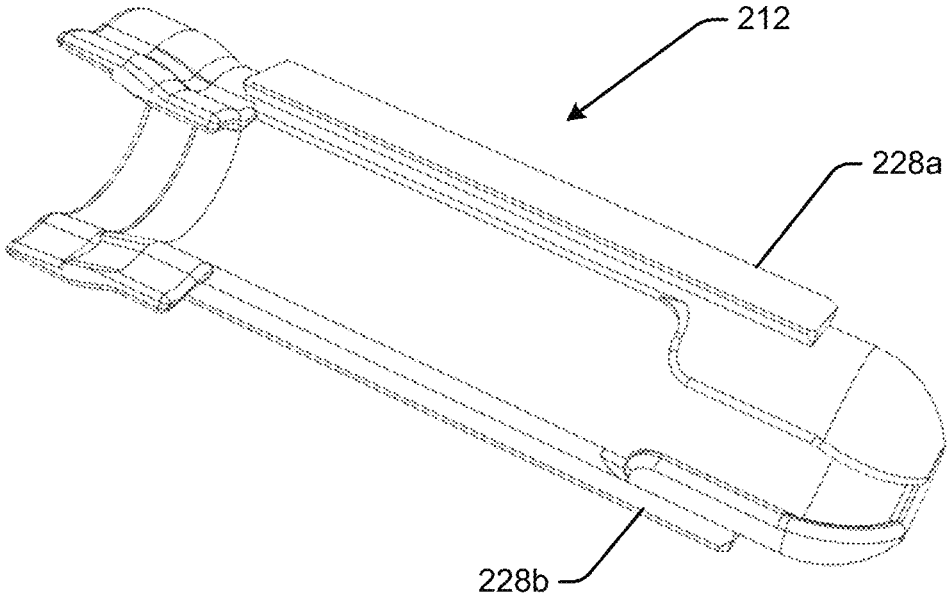
Figure 22:
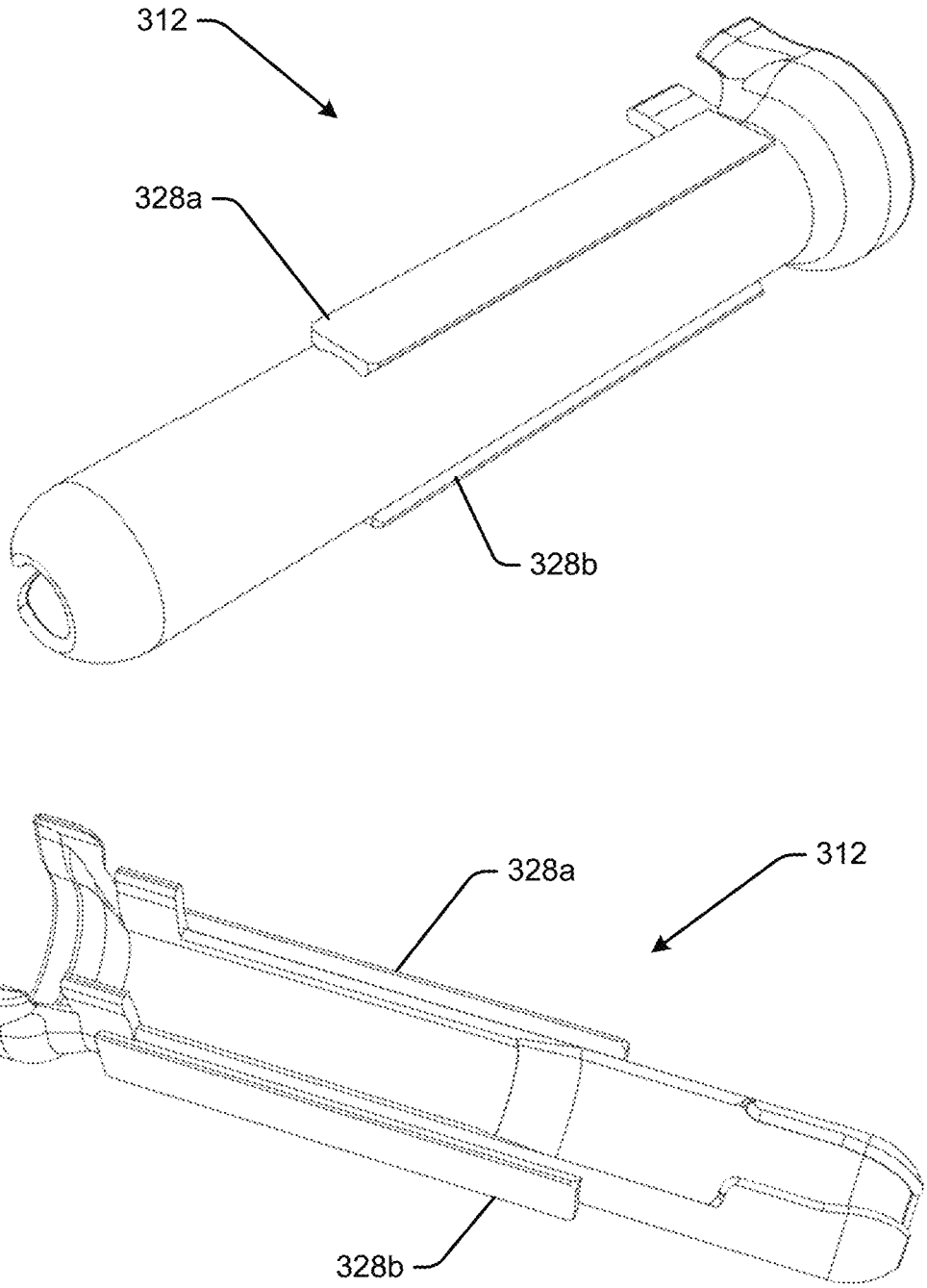
Figure 23:
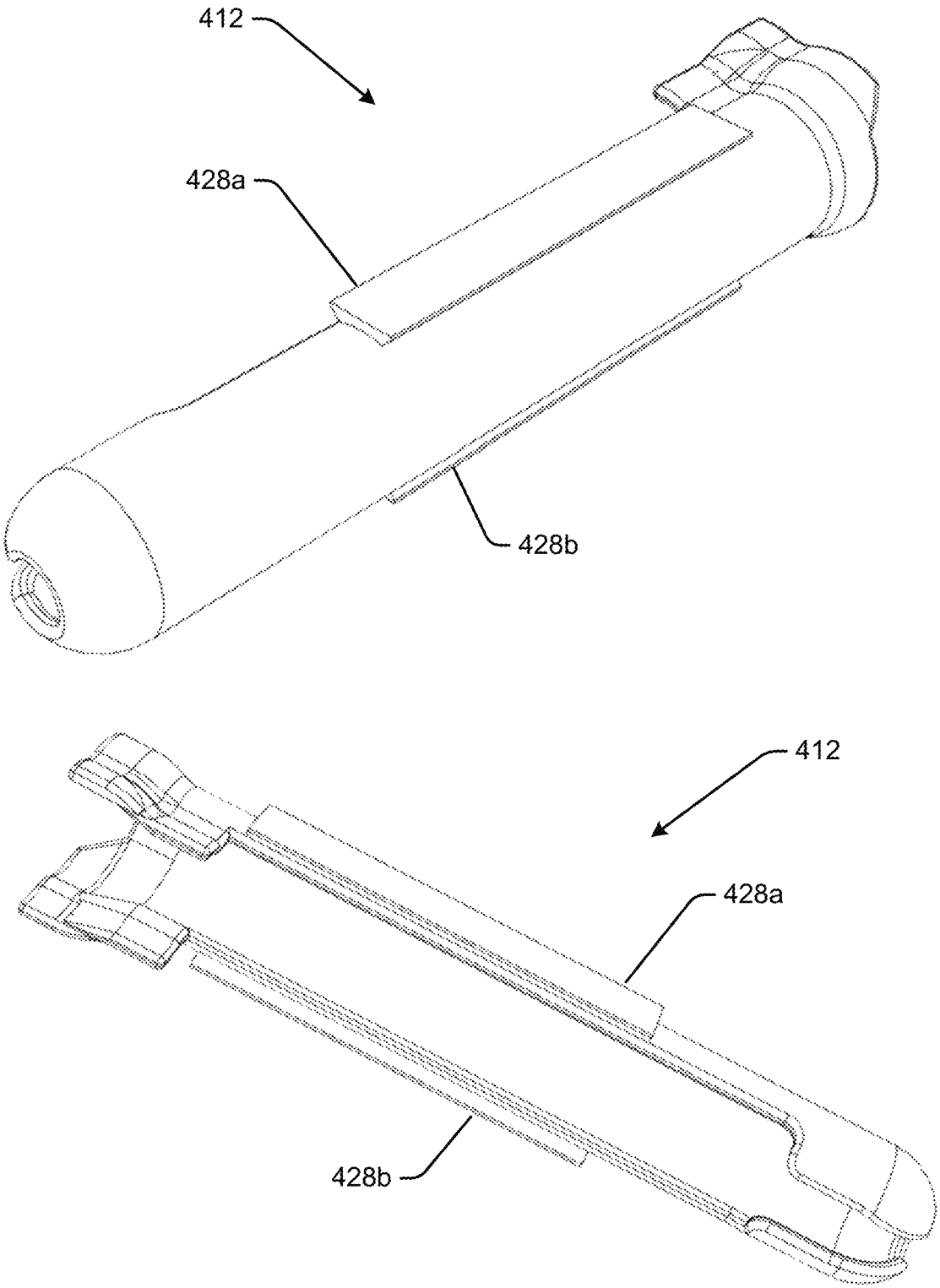
Figure 24:
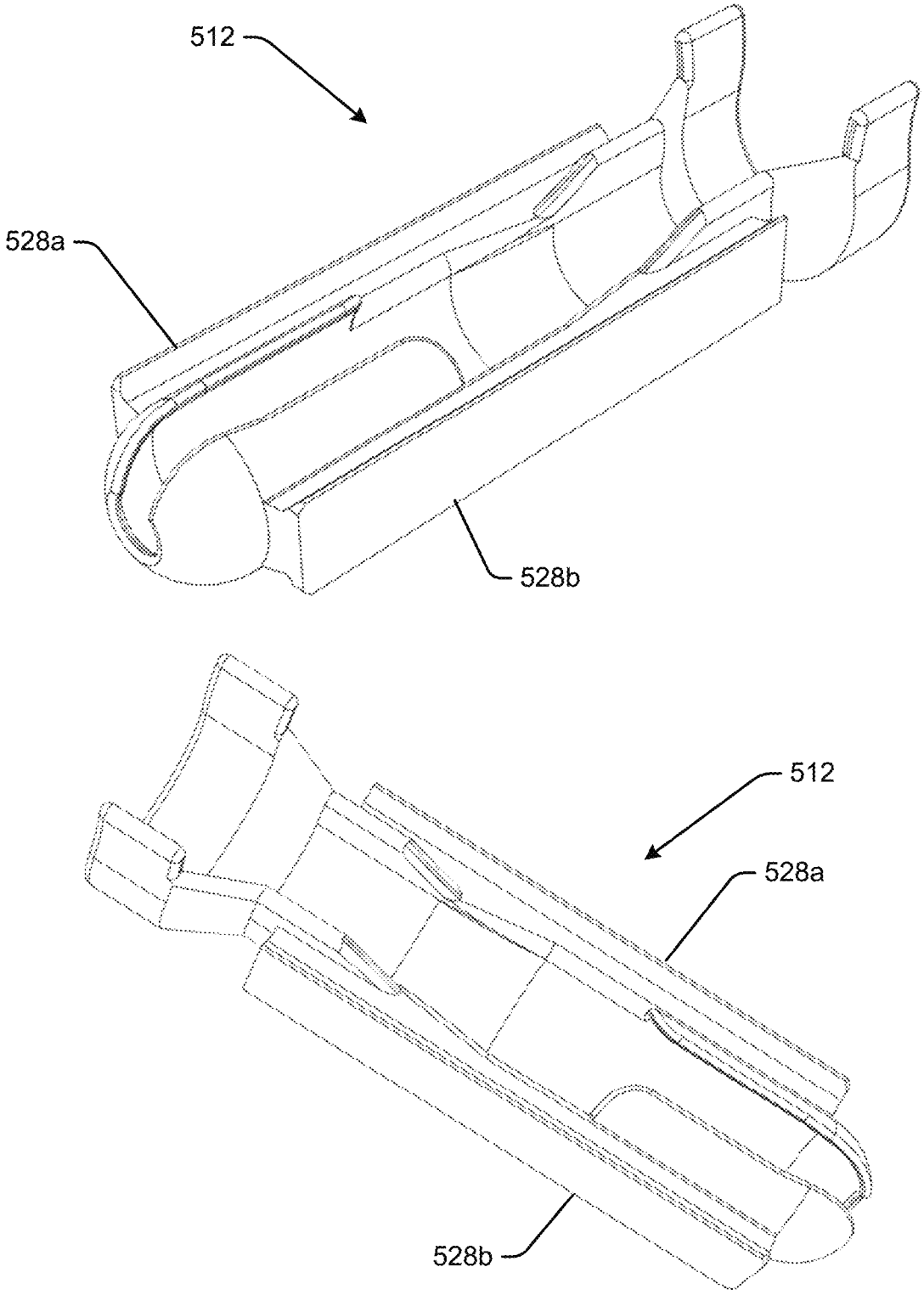
Figure 25:
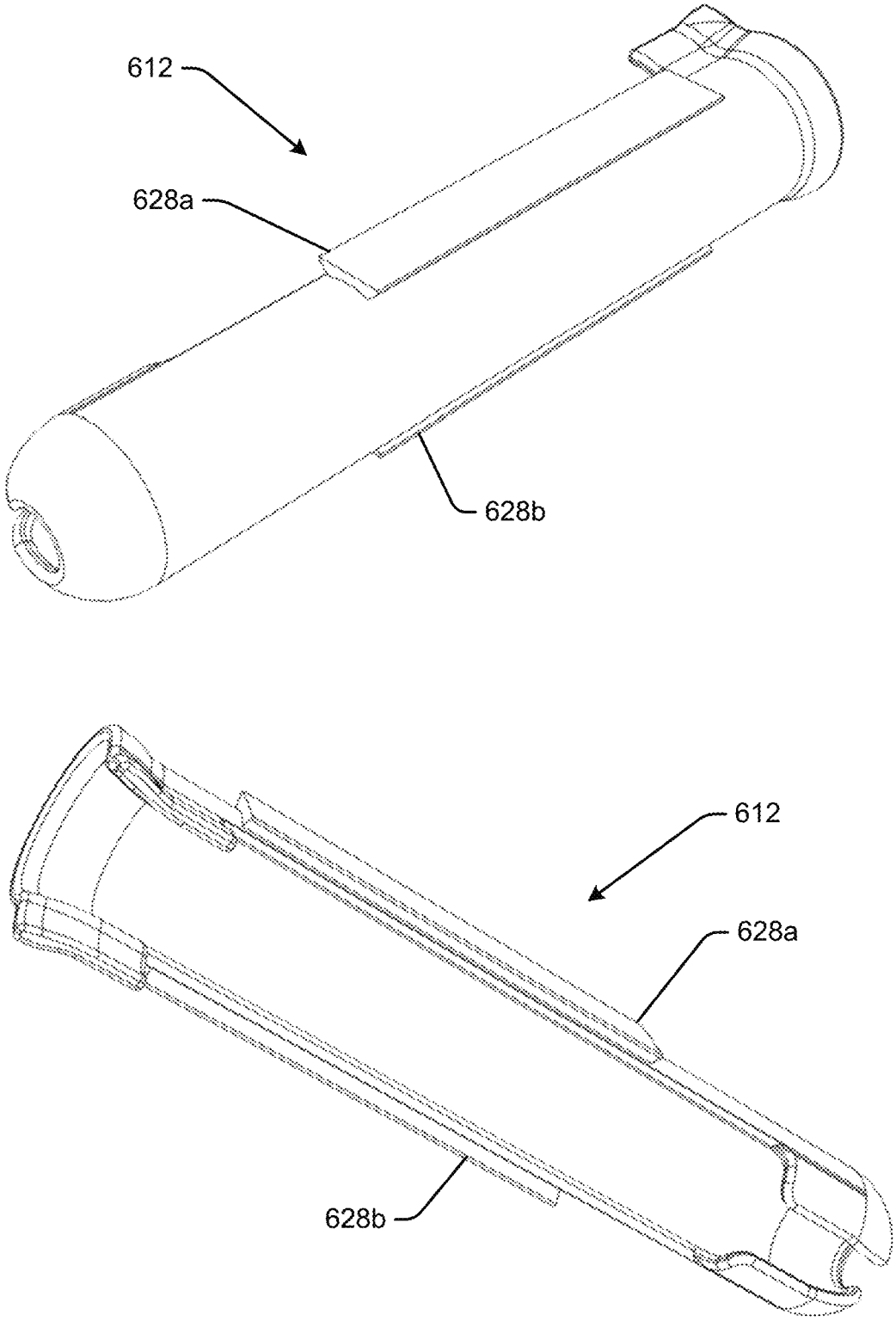

FIGS. 16-19 show another example holder 110 for a different type of vaccine gun 101, as it may be attached to the thigh of a person. FIG. 20 are top and bottom isometric views of a sleeve of the example holder 110 for the vaccine gun 101 as shown in FIGS. 16-19. It is noted that 100-series reference numbers are used to refer to similar components already described above, and may not be described again with reference to these figures.

In this example, the holder 110 for the vaccine gun 101 includes a base member 114 configured as a leg guard to protect the person against self-injection with the vaccine gun 101. At least one strap (straps 118*a*, 118*b*, and 118*c* are shown) are provided for attaching the base member 114 to a thigh of the person (or elsewhere). A mounting plate 116 is attached to the base member 114. The mounting plate 116 has a receiving channel 124.

An interchangeable sleeve 112 is configured to receive at least a portion of the vaccine gun 101 therein. In this example, the vaccine gun 101 is a bottle fed vaccine gun, having a vaccine reservoir 106. As the vaccine gun 101 is configured differently than the vaccine gun 1 in FIG. 1, the sleeve 112 is also configured to accommodate the structural differences of the vaccine gun 101, as can be seen in FIG. 20.

In an example, a first end of the interchangeable sleeve 112 is open to receive the vaccine gun 101 therein. A second partially closed end of the interchangeable sleeve 112 is provided to cover a needle of the vaccine gun 101. The interchangeable sleeve 112 slidably engages with the receiving channel 124 of the mounting plate 116 to releasably mount the sleeve 112 to the mounting plate 116. The sleeve 112 is removable from the mounting plate 116 for replacement with a different sleeve (e.g., those shown in FIGS. 21-25 by way of illustration) for a different type or configuration of vaccine gun.

As already described above, the receiving channel 124 of the mounting plate 116 has a first guide channel on the first side of the receiving channel 124, and a second guide channel on the second side of the receiving channel 124. The interchangeable sleeve 112 has a first rail member 128*a* on the first side, and a second rail member 128*b* on the second side. The first rail member 128*a* slidably mates with the first guide channel in the receiving channel 124 of the mounting plate 116, and the second rail member 128*b* slidably mates with the second guide channel in the receiving channel 124 of the mounting plate 116.

In an example, a tab member 126 on the mounting plate 116. As already described above, the tab member 126 is movable between a raised position and a depressed position. The tab member 126 may be biased in the raised position and manually movable into the depressed position for inserting the interchangeable sleeve 112 into the mounting plate 116.

During operation, the tab member 126 returns at least partially to the raised position to retain the interchangeable sleeve 112 in the receiving channel 124 of the mounting plate 116. The tab member 126 can be at least partially depressed to release the interchangeable sleeve 112 from the receiving channel 124 of the mounting plate 116.

In an example, the interchangeable sleeve 112 may also include an opening formed along one side of the sleeve 112.

In an example, the interchangeable sleeve 112 may also include a friction fit lining in at least a portion of an interior of the interchangeable sleeve to secure the vaccine gun 101 therein.

Before continuing, it should be noted that the examples described above are provided for purposes of illustration, and are not intended to be limiting. Other devices and/or device configurations may be utilized to carry out the operations described herein.

Likewise, the device is not limited to use with any particular type or configuration of vaccine gun. Still other vaccine guns may be used with the vaccine holder. Different configurations of the sleeve may be provided to accommodate the structural differences of the different vaccine guns.

FIGS. 21-25 are top and bottom isometric views of other sleeves 200, 300, 400, 500, and 600 for the example holder (e.g., holder 10 or 110) for different types of vaccine guns. However, these are merely illustrative and not limiting of sleeves which may be provided for the vaccine holder. It is noted that 200-series, 300-series, 400-series, 500-series, and 600-series reference numbers, respectively, are used to refer to similar components already described above, and may not be described again with reference to these figures.

In an example, a first end of the interchangeable sleeve 212, 312, 412, 512, and 612 is open to receive the corresponding or respective vaccine gun therein. A second partially closed end of the interchangeable sleeve 212, 312, 412, 512, and 612 is provided to cover a needle of the vaccine gun. The interchangeable sleeve 212, 312, 412, 512, and 612 slidably engages with the receiving channel of the mounting plate to releasably mount the sleeve 212, 312, 412, 512, and 612 to the mounting plate. The sleeve 212, 312, 412, 512, and 612 is removable from the mounting plate for replacement with a different sleeve for a different type or configuration of vaccine gun.

As already described above, the receiving channel of the mounting plate has a first guide channel on the first side of the receiving channel, and a second guide channel on the second side of the receiving channel. The interchangeable sleeve 212, 312, 412, 512, and 612 has a first rail member 228*a*, 328*a*, 428*a*, 528*a* and 628*a* on a first side, and a second rail member 228*b*, 328*b*, 428*b*, 528*b* and 628*b* on a second side. The first rail member 228*a*, 328*a*, 428*a*, 528*a* and 628*a* slidably mates with the first guide channel in the receiving channel of the mounting plate, and the second rail member 228*b*, 328*b*, 428*b*, 528*b* and 628*b* slidably mates with the second guide channel in the receiving channel of the mounting plate.

It is noted that the examples shown and described are provided for purposes of illustration and are not intended to be limiting. Still other examples are also contemplated.

The invention claimed is:

1. A holder for vaccine guns, comprising:

a base member configured as a leg guard to protect the person against self-injection with the vaccine guns;

at least one strap for attaching the base member to a thigh of a person;

a mounting plate attached to the base member, the mounting plate having a receiving channel; and an interchangeable sleeve comprising a generally cylindrical body configured to receive at least a portion of a vaccine gun therein, the generally cylindrical body configured for releasable mounting to the mounting plate, the interchangeable sleeve having a first end defining a mouth opening sized larger than the cylindrical body of the interchangeable sleeve, the mouth opening configured to facilitate insertion of the vaccine gun into the cylindrical body, and a second end of the interchangeable sleeve terminating in a substantially mostly closed tip except for a needle opening formed therethrough, the interchangeable sleeve further having a lengthwise opening extending longitudinally along one side of the cylindrical body, and a pair of engagement rails disposed on opposite exterior sides of the cylindrical body and extending longitudinally thereal-ong, the engagement rails being configured to slidably engage corresponding guide channels in the mounting plate to releasably secure the interchangeable sleeve to the mounting plate.

2. The holder for vaccine guns of claim 1, further comprising a tab member disposed on the mounting plate, the tab member being movable between a raised position and a depressed position and biased toward the raised position;

wherein the interchangeable sleeve, when mounted to the mounting plate via the receiving channel, is engageable with the tab member such that insertion of the interchangeable sleeve into the mounting plate causes the tab member to move toward the depressed position and thereafter return toward the raised position to retain the interchangeable sleeve in the mounting plate; and wherein the tab member and the receiving channel cooperate to provide a releasable retention system that constrains the interchangeable sleeve to guided sliding movement relative to the mounting plate while resisting unintended disengagement during use.

3. A holder for vaccine guns, comprising:

a base member configured as a leg guard to protect the person against self-injection with the vaccine guns;

at least one strap for attaching the base member to a thigh of a person;

a mounting plate attached to the base member, the mounting plate having a receiving channel; and an interchangeable sleeve comprising a generally cylindrical body configured to receive at least a portion of a vaccine gun therein, the generally cylindrical body configured for releasable mounting to the mounting plate, the interchangeable sleeve having a first end defining a mouth opening sized larger than the cylindrical body of the interchangeable sleeve, the mouth opening configured to facilitate insertion of the vaccine gun into the cylindrical body, and a second end of the interchangeable sleeve terminating in a substantially mostly closed tip except for a needle opening formed therethrough, the interchangeable sleeve further having a lengthwise opening extending longitudinally along one side of the cylindrical body, and a pair of engagement rails disposed on opposite exterior sides of the cylindrical body and extending longitudinally thereal-ong, the engagement rails being configured to slidably engage corresponding guide channels in the mounting plate to releasably secure the interchangeable sleeve to the mounting plate;

wherein the engagement rails and the guide channels cooperate to constrain movement of the interchangeable sleeve relative to the mounting plate to a sliding insertion and removal path, thereby preventing lateral disengagement during use.

4. The holder for vaccine guns of claim 3, further comprising a tab member on the mounting plate, the tab member movable between a raised position and a depressed position, the tab member having a sloped face for moving the tab member from the raised position to the depressed position, the tab member biased in the raised position and moving into the depressed position when the interchangeable sleeve engages the mounting plate and slides past the sloped face of the tab member to insert the interchangeable sleeve into the mounting plate, whereupon the tab member returns to the raised position to retain the interchangeable sleeve in the receiving channel of the mounting plate.

5. The holder for vaccine guns of claim 3, wherein the interchangeable sleeve further comprises a friction fit lining in at least a portion of an interior of the interchangeable sleeve to secure the vaccine guns therein.

6. A holder for vaccine guns, comprising:

a base member for attaching to a side of a person;

a mounting plate attached to the base member, the mounting plate having a receiving channel, the receiving channel including a first guide channel on a first side of the receiving channel and a second guide channel on a second side of the receiving channel;

an interchangeable sleeve configured to receive at least a portion of a first vaccine gun therein, the interchangeable sleeve including a first rail member slidably engaging the first guide channel and a second rail member slidably engaging the second guide channel to releasably mount the sleeve to the mounting plate, and the interchangeable sleeve removable from the mounting plate for replacement with a different sleeve for a second vaccine gun, the second vaccine gun being a different type from the first vaccine gun; and a tab member on the mounting plate, the tab member having a sloped face for moving the tab member from a raised position to a depressed position, the tab member biased in the raised position and moving into the depressed position when the interchangeable sleeve engages the first rail member and the second rail member and slides past the sloped face of the tab member for inserting the interchangeable sleeve into the mounting plate, whereupon the tab member returns to the raised position to retain the interchangeable sleeve in the mounting plate wherein the interchangeable sleeve comprises a generally cylindrical body configured to receive at least a portion of a vaccine gun therein, the generally cylindrical body configured for releasable mounting to the mounting plate, the interchangeable sleeve having a first end defining a mouth opening sized larger than the cylindrical body of the interchangeable sleeve, the mouth opening configured to facilitate insertion of the vaccine gun into the cylindrical body, and a second end of the interchangeable sleeve terminating in a substantially mostly closed tip except for a needle opening formed therethrough, the interchangeable sleeve further having a lengthwise opening extending longitudinally along one side of the cylindrical body, and a pair of engagement rails disposed on opposite exterior sides of the cylindrical body and extending longitudinally therealong, the engagement rails being configured to slidably engage the corresponding first and second guide channels in the mounting plate to releasably secure the interchangeable sleeve to the mounting plate.

7. The holder for vaccine guns of claim 6, wherein the base member is configured as a leg guard to protect the person against self-injection with the vaccine guns.

8. The holder for vaccine guns of claim 6, wherein the interchangeable sleeve has a first end open to receive the first vaccine gun therein, and the interchangeable sleeve having a second partially closed end to cover a needle of the first vaccine gun, wherein an opening is formed on the second end as a drain opening.

9. The holder for vaccine guns of claim 6, further comprising at least one leg strap connected to the base member for wrapping around and securing the base member to a thigh of the person.

10. The holder for vaccine guns of claim 6, further comprising a support strap connected to the base member, the support strap adjustable in length, the support strap having a clip for attaching to a waistband or belt worn by the person.

11. The holder for vaccine guns of claim 6, wherein the receiving channel of the mounting plate has a first guide channel on a first side of the receiving channel, and a second guide channel on a second side of the receiving channel.

12. The holder for vaccine guns of claim 11, wherein the interchangeable sleeve has a first rail member on a first side of the interchangeable sleeve, and a second rail member on a second side of the interchangeable sleeve, the first rail member mating with the first guide channel in the receiving channel of the mounting plate, and the second rail member mating with the second guide channel in the receiving channel of the mounting plate.

13. The holder for vaccine guns of claim 6, wherein the tab member returns at least partially to the raised position to retain the interchangeable sleeve in the receiving channel of the mounting plate.

14. The holder for vaccine guns of claim 6, wherein the tab member is at least partially depressed to release the interchangeable sleeve from the receiving channel of the mounting plate.

15. The holder for vaccine guns of claim 6, wherein the tab member is mounted adjacent to an opening formed in the base member for movement of the tab member into the depressed position.

16. The holder for vaccine guns of claim 6, wherein the tab member is formed on a portion of a bottom of the receiving channel, the portion of the bottom of the receiving channel separated from the mounting plate on a first side and a second side so that the portion of the bottom of the receiving channel moves apart from the mounting plate.

17. The holder for vaccine guns of claim 6, wherein the interchangeable sleeve further comprises an opening formed along one side of the interchangeable sleeve.

18. The holder for vaccine guns of claim 17, wherein the interchangeable sleeve further comprises a friction fit lining along at least a portion of an interior of the interchangeable sleeve to secure the vaccine guns therein.

* * * * *